US009964303B2

(12) United States Patent
Sullivan et al.

(10) Patent No.: US 9,964,303 B2
(45) Date of Patent: May 8, 2018

(54) COMBUSTION BOILER WITH PRE-DRYING FUEL CHUTE

(71) Applicants: Eugene Sullivan, Mobile, AL (US); Daniel R. Higgins, Tigard, OR (US)

(72) Inventors: Eugene Sullivan, Mobile, AL (US); Daniel R. Higgins, Tigard, OR (US)

( * ) Notice: Subject to any disclaimer, the term of this patent is extended or adjusted under 35 U.S.C. 154(b) by 544 days.

(21) Appl. No.: 14/592,566

(22) Filed: Jan. 8, 2015

(65) Prior Publication Data

US 2015/0300636 A1 Oct. 22, 2015

Related U.S. Application Data

(60) Provisional application No. 61/925,063, filed on Jan. 8, 2014.

(51) Int. Cl.
*F23K 1/04* (2006.01)
*F23K 3/00* (2006.01)
(Continued)

(52) U.S. Cl.
CPC ..... *F23G 5/04* (2013.01); *C07D 213/24* (2013.01); *C07D 213/74* (2013.01);
(Continued)

(58) Field of Classification Search
CPC ..... C10J 2300/0909; C10L 2290/06; F23G 2206/10; F23G 5/04; F23G 5/46;
(Continued)

(56) References Cited

U.S. PATENT DOCUMENTS 1,432,509 A 10/1922 Wood
1,517,319 A 12/1924 Seyboth
(Continued)

FOREIGN PATENT DOCUMENTS

GB 1213624 A * 11/1970 ..... C02F 11/12
JP 63065220 A * 3/1988
(Continued)

OTHER PUBLICATIONS

Unknown, "Diamond Rodding Robot," http://www.diamondpower.com.au/pdf/diamondpower/AncillaryEquipment/Rodding_robot.pdf.

*Primary Examiner* — David J Laux
(74) *Attorney, Agent, or Firm* — Scheinberg & Associates, PC; Michael O. Scheinberg

(57) ABSTRACT

A solid fuel boiler with one or more fuel chutes configured to pre-dry wet solid fuel prior to loading into a combustion chamber of the boiler, enabling higher thermal efficiencies and burning less fuel to produce the same steam quantity. The pre-drying fuel chutes pass through the boiler where hot combustion gases radiantly and convectively—heat the chute walls to dry the wet solid fuel by radiant, convective, and/or conductive heating. Agitator mechanisms or structures within the chute mix the fuel for uniform heating, break up clumps of wet fuel, regulate the speed of falling fuel, prevent sticking, dry the fuel by means of steam and/or hot air, transport and deliver a cooling medium while a chute is offline in an operating boiler, and suppress fire using steam injection. Fuel from the chute can flow into a fuel storage bin or directly into the combustion zone of the furnace.

31 Claims, 14 Drawing Sheets

(51) Int. Cl.

| | |
|---|---|
| ***F23G 5/04*** | (2006.01) |
| ***F01K 5/02*** | (2006.01) |
| ***C07D 213/24*** | (2006.01) |
| ***C07D 213/74*** | (2006.01) |
| ***C07D 239/26*** | (2006.01) |
| ***C07D 239/30*** | (2006.01) |
| ***C07D 239/34*** | (2006.01) |
| ***C07D 239/47*** | (2006.01) |
| ***C07D 239/48*** | (2006.01) |
| ***C07D 239/52*** | (2006.01) |
| ***C07D 239/54*** | (2006.01) |
| ***C07D 239/58*** | (2006.01) |
| ***C07D 241/12*** | (2006.01) |
| ***C07D 241/16*** | (2006.01) |
| ***C07D 241/18*** | (2006.01) |
| ***C07D 401/14*** | (2006.01) |
| ***C07D 403/08*** | (2006.01) |
| ***C07D 403/14*** | (2006.01) |
| ***C07D 407/08*** | (2006.01) |
| ***C07D 409/14*** | (2006.01) |

(52) U.S. Cl.

CPC ..... *C07D 239/26* (2013.01); *C07D 239/30* (2013.01); *C07D 239/34* (2013.01); *C07D 239/47* (2013.01); *C07D 239/48* (2013.01); *C07D 239/52* (2013.01); *C07D 239/54* (2013.01); *C07D 239/58* (2013.01); *C07D 241/12* (2013.01); *C07D 241/16* (2013.01); *C07D 241/18* (2013.01); *C07D 401/14* (2013.01); *C07D 403/08* (2013.01); *C07D 403/14* (2013.01); *C07D 407/08* (2013.01); *C07D 409/14* (2013.01); *F01K 5/02* (2013.01); *F23K 1/04* (2013.01); *F23K 3/00* (2013.01); *F23K 2201/20* (2013.01); *F23K 2203/103* (2013.01)

(58) Field of Classification Search

CPC ..... F23G 2201/10; F23G 2201/101; F23G 2205/14; F23G 2205/16; F23K 2201/20

See application file for complete search history.

(56) References Cited

U.S. PATENT DOCUMENTS

| | | | | | |
|---|---|---|---|---|---|
| 1,792,632 | A | | 2/1931 | Dieterle | |
| 2,110,452 | A | | 3/1938 | Moyer | |
| 2,151,642 | A | | 3/1939 | Rose | |
| 2,213,923 | A | | 9/1940 | Stuart et al. | |
| 2,250,067 | A | | 7/1941 | Martin | |
| 2,799,254 | A | * | 7/1957 | Vorkauf | F22B 31/00 122/237 |
| 3,031,982 | A | | 5/1962 | Gordon et al. | |
| 3,223,058 | A | | 12/1965 | Tanner | |
| 3,317,202 | A | | 5/1967 | Cates, Jr. et al. | |
| 3,333,556 | A | | 8/1967 | Iacobovici | |
| 3,680,503 | A | * | 8/1972 | Danielsson | F23G 5/26 110/247 |
| 3,777,676 | A | * | 12/1973 | Lagen | F23G 5/14 110/227 |
| 3,902,436 | A | | 9/1975 | Turner et al. | |
| 3,976,018 | A | | 8/1976 | Boulet | |
| 3,996,044 | A | * | 12/1976 | Petritsch | C10B 19/00 48/209 |
| 4,170,183 | A | | 10/1979 | Cross | |
| 4,254,715 | A | | 3/1981 | LaHaye et al. | |
| 4,312,278 | A | | 1/1982 | Smith et al. | |
| 4,417,528 | A | * | 11/1983 | Vining | C10J 3/02 110/185 |
| 4,423,533 | A | | 1/1984 | Goodspeed | |
| 4,480,557 | A | | 11/1984 | Hochmuth | |
| 4,528,945 | A | | 7/1985 | Virr et al. | |
| 4,577,363 | A | | 3/1986 | Wyse | |
| 4,635,379 | A | | 1/1987 | Kroneld | |
| 4,642,048 | A | | 2/1987 | Kim | |
| 4,676,176 | A | | 6/1987 | Bonomelli | |
| 4,822,428 | A | | 4/1989 | Goodspeed | |
| 4,872,834 | A | | 10/1989 | Williams, Jr. | |
| 4,884,516 | A | | 12/1989 | Linsen | |
| 4,976,208 | A | * | 12/1990 | O'Connor | F23G 5/26 110/234 |
| 5,001,992 | A | | 3/1991 | Higgins et al. | |
| 5,069,146 | A | | 12/1991 | Dethier | |
| 5,226,375 | A | | 7/1993 | Fukuda | |
| 5,239,935 | A | | 8/1993 | Morrow et al. | |
| 5,313,892 | A | | 5/1994 | Tice | |
| 5,401,130 | A | | 3/1995 | Chiu et al. | |
| 5,414,887 | A | | 5/1995 | Abel et al. | |
| 5,605,104 | A | * | 2/1997 | Gross | F23K 3/02 110/165 A |
| 5,724,895 | A | | 3/1998 | Uppstu | |
| 5,794,548 | A | | 8/1998 | Barlow | |
| 6,047,970 | A | | 4/2000 | Friend et al. | |
| 6,358,042 | B1 | | 3/2002 | Moriguchi | |
| 6,532,880 | B2 | | 3/2003 | Promuto | |
| 6,662,735 | B2 | * | 12/2003 | Tischer | C10J 3/26 110/224 |
| 8,590,463 | B1 | | 11/2013 | Higgins et al. | |
| 8,707,876 | B2 | | 4/2014 | Higgins et al. | |
| 2009/0270817 | A1 | | 10/2009 | Moreno et al. | |
| 2013/0247800 | A1 | | 9/2013 | Higgins et al. | |
| 2013/0276723 | A1 | | 10/2013 | Higgins et al. | |

FOREIGN PATENT DOCUMENTS

| | | | | |
|---|---|---|---|---|
| JP | 08-245072 | | 9/1996 | |
| SU | 1395904 | A1 | 6/1985 | |
| WO | WO 2011124762 | A1 * | 10/2011 | F23G 5/04 |

* cited by examiner

COMBUSTION BOILER WITH PRE-DRYING FUEL CHUTE

This application claims priority from U.S. Prov. App. 61/925,063 filed Jan. 8, 2014, which is hereby incorporated by reference.

TECHNICAL FIELD OF THE INVENTION

The present invention relates to boilers employing the combustion of biomass and other solid fuels, and more specifically to the use of fuel chutes to heat and dry wet solid fuels.

BACKGROUND OF THE INVENTION

Combustion boilers use solid fuels, such as coal, bark, biomass trimmings, wood or other biomass pellets, sawdust, tire derived fuel, refuse, straw, bagasse, or combinations of these, sometimes accompanied by fossil fuels. In many cases, these fuels either have high initial moisture content, or are stored outdoors exposed to rain and snow. In these cases, the fuels may contain water (or even ice) content which is too high for proper burning in a combustion boiler as commonly used by industry and utilities for generation of steam to perform chemical processes and/or to generate electricity.

To reduce the moisture content of dry fuels prior to their introduction into the combustion chambers of boilers, various types of fuel dryers are commonly employed. Most fuels dryers can be classified as a direct dryer or an indirect dryer. Direct dryers heat and dry the fuel by direct contact with the heat-providing fluid, which may be steam and/or hot air. Indirect dryers separate the wet fuel from the heat source using a heat exchange surface.

The choice of type of dryer depends on the biomass characteristics and the economics of the particular application of the boiler being supplied by the fuel. The advantages of drier fuel include higher efficiency, lower air emissions and improved boiler operation. Various types of dryers are employed, the main types being rotary dryers, flash dryers, and superheated steam dryers. Each dryer type has advantages depending on the material size, allowable space for the dryer, energy usage, fire risk minimization, environmental considerations (air emissions and generation of wastewater), the possibility of integrating the dryer to the process, and finally added costs.

The principle benefit of burning drier fuels is to increase the thermal efficiency of the boiler, thereby enabling reduced fuel consumption for the amount of steam produced. This increase in efficiency occurs through the higher flame temperatures possible when burning drier fuels. This benefit arises since with wet fuel some of the combustion heat is necessarily used to evaporate the water (and possibly melt the ice) out of the fuel prior to burning. Higher flame temperatures have multiple benefits, including larger thermal gradients for radiant heat transfer (which goes as the fourth-power of temperature, where the temperature is measured from absolute zero)—thus for the same amount of heat transfer, smaller banks of steam-generating tubes may be employed. Higher flame temperatures enhance combustion, producing lower carbon-monoxide levels and reduced fly ash leaving the boiler. Also, a higher percentage of the total energy content of the fuel is released at higher combustion temperatures—this may enable the usage of smaller fire boxes and lower-capacity ash handling systems. Further benefits of higher combustion temperatures include less need for excess combustion air while still maintaining acceptable exhaust opacity and CO levels. Less need for combustion air may enable use of smaller forced draft or induced draft blowers.

However, there are some valid concerns with using dried fuel. The higher combustion temperatures afforded by the use of pre-dried fuel may lead to slag formation (fusion of ash). In the prior art, problems with the dryer (causing the fuel to be inadequately dried, or not dried at all) had the potential to lead to wetter fuels being introduced to the boiler than it was designed for. Higher combustion temperatures may also accelerate corrosion through the formation of sulfuric acid.

SUMMARY OF THE INVENTION

An object of the invention is to provide a method for drying wet solid fuels.

A pre-drying fuel chute is positioned the combustion chamber of a boiler. Hot combustion gases heat the outer surface of the fuel chute by a radiation, and in some configurations, also by convection.

The foregoing has outlined rather broadly the features and technical advantages of the present invention in order that that detailed description of the embodiments that follows may be better understood. Additional features and advantages of the embodiments will be described hereinafter. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

DETAILED DESCRIPTION OF ALTERNATIVE EMBODIMENTS

Figure 1:
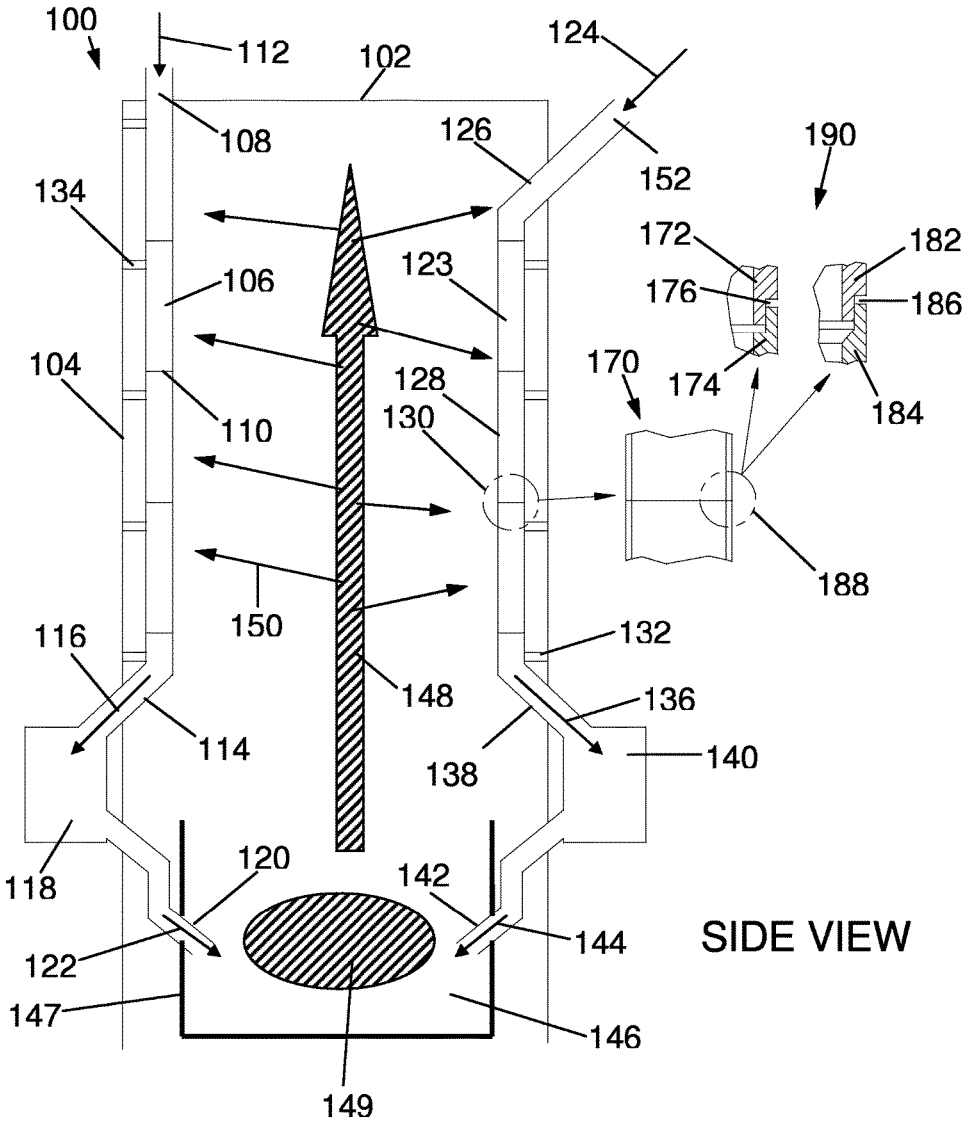
FIG. 1 is a schematic side cross-sectional view of a boiler embodying the present invention.

Applicants have determined that there are several stages of drying for wet solid fuels.

Stages of Drying

There are typically several stages of drying for wet solid fuels:

1) Heating up to the wet bulb temperature—this brings the wet fuel up to a temperature at which the surface water begins to evaporate,
2) Evaporation of surface water—this process can occur so quickly that the fuel surface may become dry enough to become a fire risk, even though the interior of the fuel may remain both cool and wet,
3) Drive water from the interior of the fuel—clearly this process will be enhanced in any dryer design which facilitates the breaking up of fuel clumps, thereby bringing all interior points nearer to a surface,
4) Removal of most or all of the remaining water—in general it is preferred not to entirely dry the fuel to avoid excessive fire and explosion risk,
5) Cooling off of the fuel after drying—once the fuel emerges from the dryer, it typically may be stored in a fuel bin prior to being fed into the combustion chamber of the boiler. Any heat contained by the fuel thus is lost and must be resupplied by the combustion process—this is a disadvantage of any process in which the fuel is not directly pre-dried during introduction to the boiler and represents one economic advantage of boilers configured according with embodiments where the fuel may directly enter the fire box immediately after passage through the pre-drying fuel chute.

Embodiments of pre-drying fuel chutes typically operate as indirect dryers, since the hot combustion gases are typically used to heat the wall of the fuel chute, which then radiantly heats the fuel inside. However, in some embodiments, pre-drying fuel chutes may also operate as direct dryers, since steam and/or hot gas or air may be introduced to the interior of the fuel chute, for example, by means of agitator mechanisms (see FIGS. 6-22) or by the falling fuel drawing hot combustion gas into the fuel chute, or by forcing hot gas or air through the chute. Thus the various benefits and disadvantages of the two basic dryer types may be encountered in boilers configured with pre-drying fuel chutes. An example of a combustion boiler operating with a fuel chute that dries fuel is given in U.S. Pat. No. 8,590,463 for "Method and Apparatus for Drying Solid Fuel", issued Nov. 26, 2013, where the fuel chutes are configured as part of the boiler sidewalls and provide some pre-drying of the fuel falling downwards within them.

Some embodiments provide a method and structure for increasing the thermal efficiency of solid fuel boilers, thereby enabling the use of less fuel to generate the same quantity of steam.

Some embodiments provide a method and structure for drying wet solid fuel utilizing the hot combustion gases in the boiler in an indirect drying process where the wall of the fuel chute serves at the heat transfer surface.

In some embodiments, the fuel will be heated and at least partially dried in the chutes but a significant portion of the moisture may be flashed off after the fuel is deposited in the fuel bin. The fuel bin is then vented to relieve the steam. Volatile gases may also be present and it may be desirable to incinerate the gasses or condense the moisture to separate it and then incinerate the volatiles.

Some embodiments provide a method and structure for venting evaporated steam and volatile gases from one or more fuel storage bins, into which pre-dried wet solid fuels have previously been loaded from one or more pre-drying fuel chutes. Subsequently, the vented gases may be incinerated and the vented moisture condensed. If safe to do so, in some embodiments the fuel storage bins may be vented to the air.

Some embodiments prevent the free-fall of wet solid fuel through the fuel chute, thereby slowing down the passage of the fuel to enable adequate heating and drying of the fuel prior to loading into the combustion chamber of the boiler.

Some embodiments provide structures and methods for breaking up clumps of wet solid fuel during the transit of the fuel through a pre-drying fuel chute. Fuel clumps may be broken up by impact of the clumps with structures within the fuel chute as they fall down the fuel chute, by impact of various agitator structures moving within the fuel chute against the fuel, or by impact of high-velocity jets of steam and/or hot air which may be injected into the fuel by structures within the fuel chute.

Some embodiments provide additional heat for drying of wet solid fuels by introduction of steam and/or hot air into the fuel chute by means of agitator structures in a direct drying process.

Some embodiments provide a steam purge for cleaning the interior of the fuel chute and/or for cooling a fuel chute if it is off-line while the boiler is still in operation.

To prevent the chute material from overheating, some embodiments limit and regulate the amount of heating and drying of the initially wet solid fuel by adjusting the agitation and/or residence time of the fuel as it falls down through the pre-drying fuel chute. The fuel cools the chute, but the cooling is less efficient after the fuel gets hot. In some embodiments the fuel is not dried to its final dryness in the chute, to prevent the chute from overheating.

In some embodiments, one or more of the following heat transfer mechanisms may function to heat and dry the fuel passing downwards through the pre-drying fuel chute: 1)

indirect radiant heating of the fuel by the inner surfaces of the walls of the chute, 2) convective heating of the fuel by hot air and/or steam within the chute, and 3) conductive heating of the fuel by direct contact with the inner surfaces of the walls of the chute.

In some embodiments, the entire pre-drying fuel chute may be rotated to perform the functions of: 1) moving the fuel downwards within the chute, 2) regulating the rate of falling of fuel downwards to ensure adequate but not excessive drying, 3) to break up clumps of wet fuel, thereby facilitating more even heating and drying, and 4) to mix the fuels within the chute, thereby ensuring more uniform drying.

In some embodiments, wet solid fuel may be loaded into the pre-drying fuel chute at the top of the boiler, the fuel first falls vertically downwards, and then into a fuel bin or directly into the combustion chamber through a feed mechanism.

In other embodiments, wet solid fuel may be loaded into the pre-drying fuel chute at the upper side of the boiler, wherein the fuel chute angles into the boiler, connects with a vertical portion of the fuel chute, at the bottom of which the fuel enters a fuel bin or goes directly into the combustion chamber through a feed mechanism.

In yet other embodiments, the fuel chute may be configured as a generally straight tube angled across the boiler within the upward-flowing stream of combustion gases.

In some embodiments, one or more fuel agitator mechanisms are configured within the fuel chute to facilitate the flow of wet solid fuel downwards within the pre-drying fuel chute.

In some embodiments, one or more fuel agitator mechanisms are configured within the fuel chute to facilitate the breaking up of clumps of wet solid fuel falling downwards within the pre-drying fuel chute, thereby enhancing heating and drying of the wet solid fuel.

In some embodiments, one or more fuel agitator mechanisms are configured within the fuel chute to facilitate the heating and drying of the wet solid fuel by means of a direct-heating process that introduces steam and/or hot air in a flow directed at the wet solid fuel.

In some embodiments, one or more fuel agitator mechanisms are configured within the fuel chute to facilitate fire suppression by introducing steam in a flow directed at the wet solid fuel.

In some embodiments, a portion of the outer surface of the pre-drying fuel chute which receives larger amounts of thermal radiation from the hot combustion gases is configured to have high thermal absorptivity, thereby enhancing absorption of radiant energy from the combustion gases which are hotter than the fuel chute.

In some embodiments, a portion of the outer surface of the pre-drying fuel chute which faces generally away from the hot combustion gases and towards the side walls of the boiler is configured to have low thermal emissivity, thereby reducing the loss of thermal energy from the fuel chute towards the sidewalls which are cooler than the fuel chute.

In some embodiments, the inner wall of the pre-drying fuel chute is configured to have high emissivity, thereby enhancing the emission of thermal energy towards the solid fuel within the chute which is cooler than the fuel chute.

In some embodiments, a flow of hot combustion gases is directed into an end of the pre-drying fuel chute to enhance the flow of thermal energy to the wet solid fuel within the chute.

In some embodiments, the hot combustion gases within the pre-drying fuel chute flow co-currently downwards along with the generally downward-falling wet solid fuel.

In some embodiments, the hot combustion gases within the pre-drying fuel chute flow upwards against the direction of the generally downward-falling wet solid fuel.

In some embodiments, a fuel agitator mechanism is configured to perform one or more of the functions of:

a) moving the fuel downwards within the fuel chute,
b) preventing sticking of fuel to the inner surfaces of the fuel chute,
c) ensuring mixing of the fuel so that fuel which is near, or in contact with, the walls of the chute is transported to the interior of the chute, while fuel from the interior of the chute is moved out towards, or into contact with, the walls of the chute in a continual inward and outward mixing process as the fuel moves downwards within the chute,
d) breaking up clumps of wet solid fuel to ensure more thorough heating and drying,
e) indirectly heating and drying the fuel by radiant heating from the inner wall of the fuel chute,
f) directly heating and drying the fuel by contact with the hot inner surfaces of the chute, wherein this contact with the walls will be intermittent as the fuel is agitated within the chute, consistent with function c, above,
g) directly heating and drying the fuel by injection of steam and/or hot air to the interior of the fuel chute,
h) suppressing fire by injecting steam into the fuel chute,
i) removing water vapor evaporated from the wet solid fuel from the interior of the fuel chute, and
j) removing volatile gases emitted by the drying fuel from the interior of the fuel chute to reduce the fire risk within the chute.

The fuel agitation function enables a more even heat transfer process to the fuel to ensure that no portions of the fuel are overheated, which could result one or more of the following deleterious results:

1) excessive amounts of volatile gasses being emitted,
2) higher risk of fire within the chute,
3) formation of varnishes on the inner walls of the chute and/or on the agitator mechanism, and
4) the overall reduction in the fuel heating and drying efficiency.

Preferred Boiler Configurations

Figure 3:
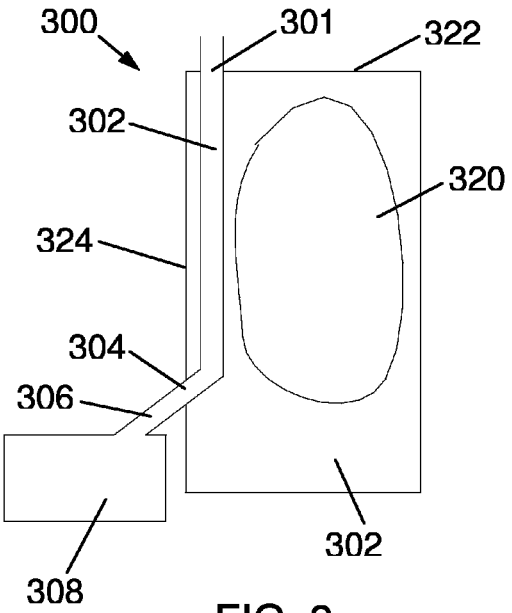
FIG. 3 is a schematic side cross-sectional view of a boiler employing a top-loading pre-drying fuel chute.
Figure 4:
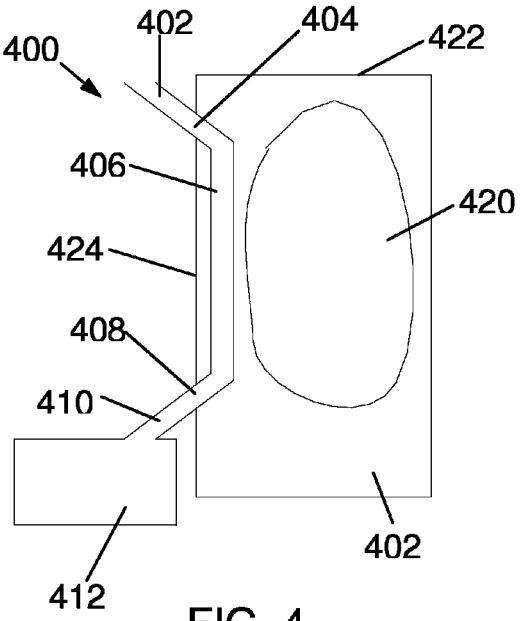
FIG. 4 is a schematic side cross-sectional view of a boiler employing a side-loading pre-drying fuel chute.
Figure 5:
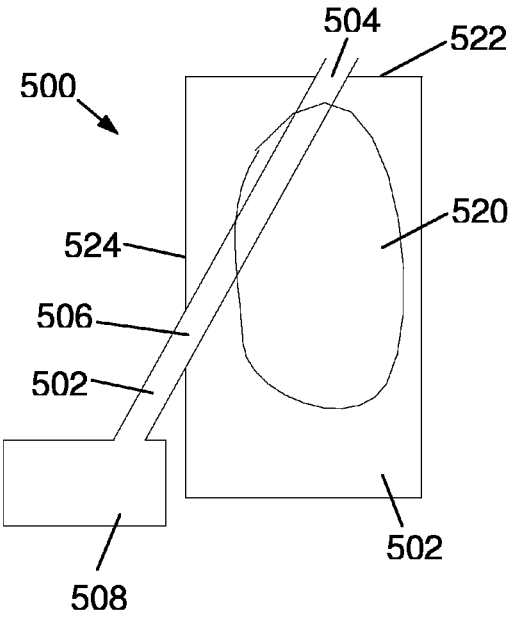
FIG. 5 is a schematic side cross-sectional view of a boiler employing a tilted straight pre-drying fuel chute.

FIG. 1 is a schematic side cross-sectional view of a combustion boiler 100 that includes a combustion chamber 102 having therein two fuel chutes for drying fuel. At the left side, a top-loading pre-drying fuel chute 106 is illustrated (see also FIG. 3) while at the right side, a side-loading chute 123 is shown (see also FIG. 4). Boiler 100 may utilize a single type of pre-drying fuel chute as shown in FIGS. 3-5, or a combination of two or more. Arrow 112 illustrates schematically the loading of wet solid fuel through opening 108 at the top of fuel chute 106. Chute 106 may typically comprise multiple sections with joints 110 for expansion and to enable the use of sections of chute preferably in the range of 20 to 30 feet long for easier shipment and on-site assembly. Mounts 134 attach chute 106 to side wall 104. At the lower end of chute 106, a downward-sloped chute 114 conveys fuel 116 into fuel bin 118. Fuel 122 then slides through chute 120 into a combustion zone 146. Combustion zone 146 has walls 147 surrounding a single chamber or multiple separate combustion chambers (not shown), each fed fuel by one or more pre-drying fuel chutes. The combustion zone 146 in the combustion chamber contains the burning fuel 149. At the right, a second pre-drying fuel chute is shown. An upper sloped chute 126 is shown being loaded with wet solid fuel 124 through opening 152. Fuel 124 then slides down into vertical chute 128. At the bottom of vertical chute 128, a downward-sloped chute 138 conveys fuel 136 into fuel bin 140. Fuel 144 then slides through chute 142 into the combustion zone 146. Mounts 132 attach chute 128 to side wall 104.

Shaded arrow 148 represents the upward-rising hot combustion gases coming from combustion zone 146. Radiant heat 150 from the hot gas zone 148 heats the two pre-drying fuel chutes and by a combination of radiant heating, and in some cases also convective heating depending on the degree of direct contact between hot gases 148 and the fuel chutes A close-up of region 130 shown in view 170 shows details of the expansion joint 188. Two more close-up views 190 illustrate two alternative expansion joint designs, but other expansion joint designs can be used. Upper section 172 fits into lower section 174 with a gap 176 to allow for thermal expansion of sections. Each section is preferably attached by a separate mount 132 or 134 to the sidewalls 104. Upper section 182 fits into lower section 184 with a gap 186. An inner sloped portion on lower section 184 prevents the accumulation of wet solid fuel in the inner part of gap 186 which might tend to inhibit the expansion of section 184 into section 186 upon heating and resultant thermal expansion.

Although the initially wet solid fuel may be heated and partially dried during its passage downwards through the pre-drying fuel chute to either of the fuel bins 118 and 140, because the fuel is heated when it exits from the chutes into the fuel bins, it will typically continue to evaporate moisture and outgas volatile gases after entering the fuel bins, prior to being fed to the combustion zone through chutes 120 and 142. Thus, typically fuel bins 118 and 140 may be configured with venting (either passive or with active pumping) out to one or more incinerators (for the volatile gases) and/or condensers (for the evaporated moisture). Alternatively, if safe to do so, fuel bins 118 and 140 may be vented to the air.

Figure 2:
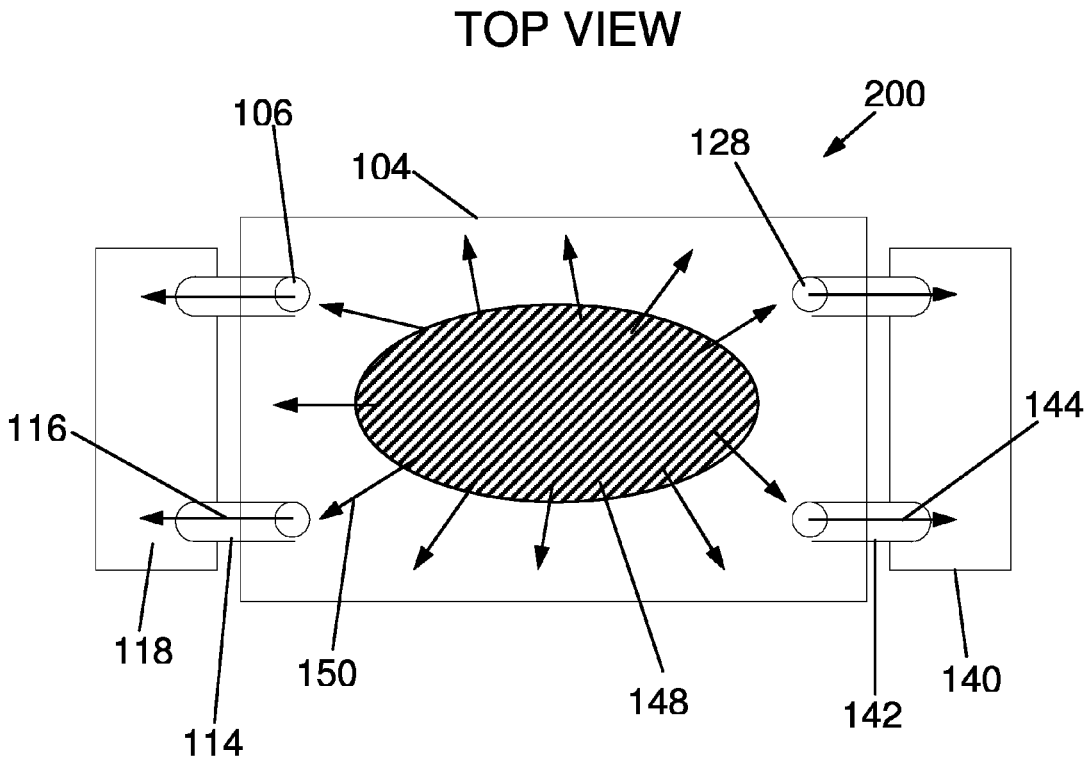
FIG. 2 is a schematic top cross-sectional view of the boiler shown in FIG. 1.

FIG. 2 is a schematic top cross-sectional view 200 of the boiler of FIG. 1. Callouts here correspond to those in FIG. 1.

Alternative Pre-Drying Fuel Chute Configurations

FIGS. 3-5 illustrate schematically three alternative configurations for embodiments of a pre-drying fuel chute—one or more of these configurations may be employed within a single boiler. Each of these configurations may employ one or more of the fuel agitation and drying mechanisms illustrated in FIGS. 6-22, but other fuel agitation and drying mechanisms may be employed in any of the three pre-drying fuel chute configurations illustrated in FIGS. 3-5 within the scope of the invention. The preferred pre-drying fuel chute employs the hot combustion gases in an indirect heating method to heat and dry wet solid fuels prior to their loading into the combustion chamber of the boiler. The three fuel chute configurations shown in FIGS. 3-5 are exposed to the radiant heat energy emitted by the combustion gases. In some cases, the fuel chutes are also in direct contact with the combustion gases (especially in FIG. 5), and thus are also heated convectively. In contrast with the boiler sidewalls and roof, which contain water and/or steam which maintains their temperatures more constant and typically in the range of ~500 to 600 F, the walls of the chute may typically reach higher temperatures since the solid fuel, even with relatively high initial moisture contents, will provide less efficient cooling of the walls of the chutes, which may consequently reach higher temperatures than the range of ~500 to 600 F. Since the rate of heat transfer increases with the differential temperature, the heat transfer to the chutes will thereby be reduced (per unit area), relative to the heat transfer occurring between the hot combustion gases and the sidewalls and roof of the boiler. Thus, although the fuel chutes may reach higher temperatures than the sidewalls and roof, the equilibrium rate of heat transfer per unit area may be less. Because the fuel chutes may be hotter than the sidewalls, the fuel chutes may undergo greater thermal expansion, necessitating that the fuel chute (which may be supported by the sidewalls) be configured to accommodate this differential thermal expansion. Such accommodation may employ telescoping structures or expansion joints, as is familiar in the art. For maintenance purposes, individual sections of the fuel chute may typically extend for 20 to 30 feet. A typical boiler may comprise a multiplicity of pre-drying fuel chutes, preferably up to four or more per boiler.

FIG. 3 is a schematic side cross-sectional view 300 of a boiler 322 employing a top-loading pre-drying fuel chute. The pre-drying fuel chute comprises a vertical tube 302 with a fuel loading opening 301 at the top, and a downward-sloping lower tube 304 with an exit opening 306 into fuel bin 308. Wet solid fuel to be pre-dried prior to being fed into combustion chamber 302 is first loaded into opening 301 by a loading mechanism (not shown) as is familiar to those skilled in the art. The initially-wet fuel falls down the vertical tube 302 of the pre-drying fuel chute due to gravity, and optionally also due to agitation forces induced by one or more fuel agitation and drying mechanisms. At the bottom of the vertical tube 302, the falling fuel is deflected into downward-sloping tube 304 which passes outwards through the side wall 424 of boiler 422. The dried fuel then enters fuel bin 308 through exit opening 306 of sloped tube 304. As the fuel passes through tubes 302 and 304 of the pre-drying fuel chute, the walls of the chute are themselves heated by radiation, and in some cases also convection, from the hot combustion gases 320. The heated walls of the chute then heat the fuel radiantly (see FIG. 22). Hot gases flowing through the tube (either counter-currently upwards or co-currently downwards) are heated by the walls of the fuel chute, and subsequently also heat the fuel. A third, optional, source of heating of the fuel may be steam and/or hot air admitted into the interior of the pre-drying fuel chute from a fuel agitation and heating mechanism, such as those illustrated in FIGS. 6-22.

FIG. 4 is a schematic side cross-sectional view 400 of a boiler 422 employing another embodiment of a side-loading pre-drying fuel chute. The pre-drying fuel chute comprises three parts: a downward-sloping first tube 404, a vertical tube 406, and a downward-sloping tube 408. Wet solid fuel to be pre-dried prior to being fed into combustion chamber 402 is first loaded into opening 402 by a loading mechanism (not shown) as is familiar to those skilled in the art. The wet fuel falls down the downward-sloping tube portion 404, which passes inwards through side wall 424 of boiler 422. Next, the fuel moves into the vertical tube 406, and then into downward-sloping tube 408 which passes outwards through side wall 424 of boiler 422. The dried fuel then passes through exit 410 of tube 408 into fuel bin 412. In all of tubes 404, 406 and 408 the fuel is moved downwards by gravity. In one or more of tubes 404, 406, and 408, the fuel may also be moved downwards by agitation forces induced by one or more fuel agitation and drying mechanisms. As the fuel passes through tubes 404, 406, and 408, of the pre-drying fuel chute, the walls of the chute are themselves heated by radiation, and in some cases also convection, from the hot combustion gases 420. The heated walls of the chute then heat the fuel radiantly (see FIG. 22). Hot gases flowing through the tube (either counter-currently upwards or co-currently downwards) are heated by the walls of the fuel chute, and subsequently also heat the fuel. A third, optional, source of heating of the fuel may be steam and/or hot air admitted into the interior of the pre-drying fuel chute from a fuel agitation and heating mechanism, such as those illustrated in FIGS. 6-22.

FIG. 5 is a schematic side cross-sectional view 400 of a boiler 522 employing still another embodiment of a side-loading pre-drying fuel chute. The pre-drying fuel chute comprises a single downward-sloping tube 506. Wet fuel to be pre-dried prior to being fed into combustion chamber 502 is first loaded into opening 504 by a loading mechanism (not shown) as is familiar to those skilled in the art. The wet fuel falls down the downward-sloping tube 506, which passes inwards through the top of boiler 522, and then outwards through side wall 524 of boiler 522. The dried fuel then passes through exit 502 of tube 506 into fuel bin 508. In tube 506 the fuel is moved downwards by gravity. In tube 506 the fuel may also be moved downwards by agitation forces induced by one or more fuel agitation and drying mechanisms, as shown in FIGS. 6-22. As the fuel passes through tube 506 of the pre-drying fuel chute, the walls of the chute are themselves heated by radiation and convection from the hot combustion gases 520. The heated walls of the chute then heat the fuel radiantly (see FIG. 22). Hot gases flowing through the tube (either counter-currently upwards or co-currently downwards) are heated by the walls of the fuel chute, and subsequently also heat the fuel. A third, optional, source of heating of the fuel may be steam and/or hot air admitted into the interior of the pre-drying fuel chute from a fuel agitation and heating mechanism, such as those illustrated in FIGS. 6-22. An advantage of the straight chute in FIG. 5 is the lack of bends (see FIGS. 3 and 4), which typically represent the regions of highest wear in fuel chutes.

In some embodiments, for example in FIG. 3, the vertical portion 302 of the pre-drying fuel chute may be configured to pass through a horizontal step in the sidewall 324, thereby enabling the elbow (bend) in the chute between vertical portion 302 and chute 304 to be outside the boiler. This configuration enables the chute to be supported from the bottom. In FIG. 4, a similar configuration could be employed with vertical portion 406 and sidewall 424.

In the two configurations of FIGS. 3 and 4 just described with steps in the sidewalls, vertical portions 302 and 406, as well as chute 506 in FIG. 5, may be configured to rotate. Rotation of the fuel chute could enable more uniform heating circumferentially around the fuel chute, thus ensuring more even heating and drying of the fuel inside, as well as avoiding any possible bowing of the chute due to uneven thermal expansion. After the chute rotates approximately half-way around, heat absorbed by that portion of the chute wall when it faced the hot combustion gases may be re-radiated towards the tube wall (which is cooler), thereby reducing temperature differentials within the tube wall between those tubes directly exposed to the combustion gases and those tubes shielded by the fuel chute. Thus any possible need for modification to the circulation circuits of the boiler (to accommodate uneven tube wall heating) will likely be eliminated.

As is familiar to those skilled in the art, various drain and vent lines would typically be required for the pre-drying fuel chutes illustrated in FIGS. 3-5. For example, drains would be required to remove liquids from the bottoms of fuel bins 308, 412, and 508. Vents to remove volatile gases would typically be configured at the tops of fuel bins 308, 413, and 508. Similarly, at the bottoms and tops of the pre-drying fuel chutes in FIGS. 3-5, drains and vents, respectively, would typically be configured. As is familiar in the art, non-condensable gases emerging from these vents could be incinerated and other gases condensed to liquids by a chiller. Alternatively, if safe to do so, fuel bins 308, 413 and/or 508 may be vented to the air.

First Embodiment of a Fuel Agitator and Heating Mechanism

Figure 6:
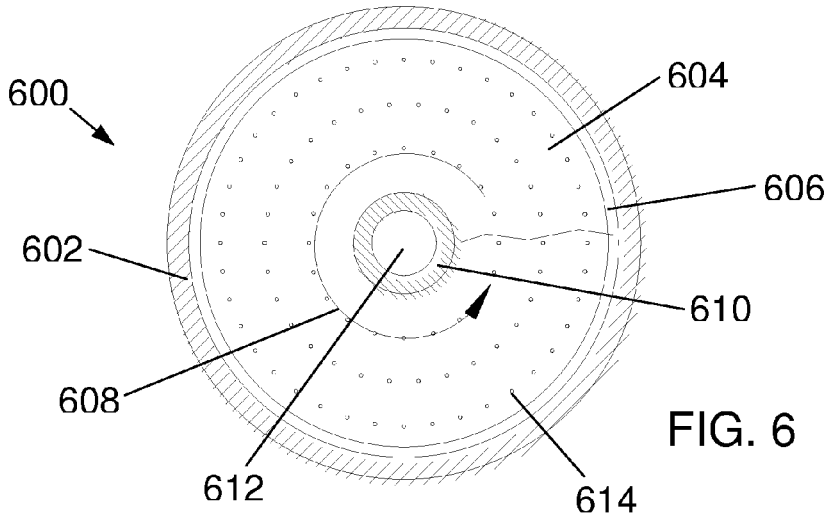
FIG. 6 is schematic top cross-sectional view of a first embodiment of a pre-drying fuel chute employing a fuel agitating and drying mechanism.
Figure 7:
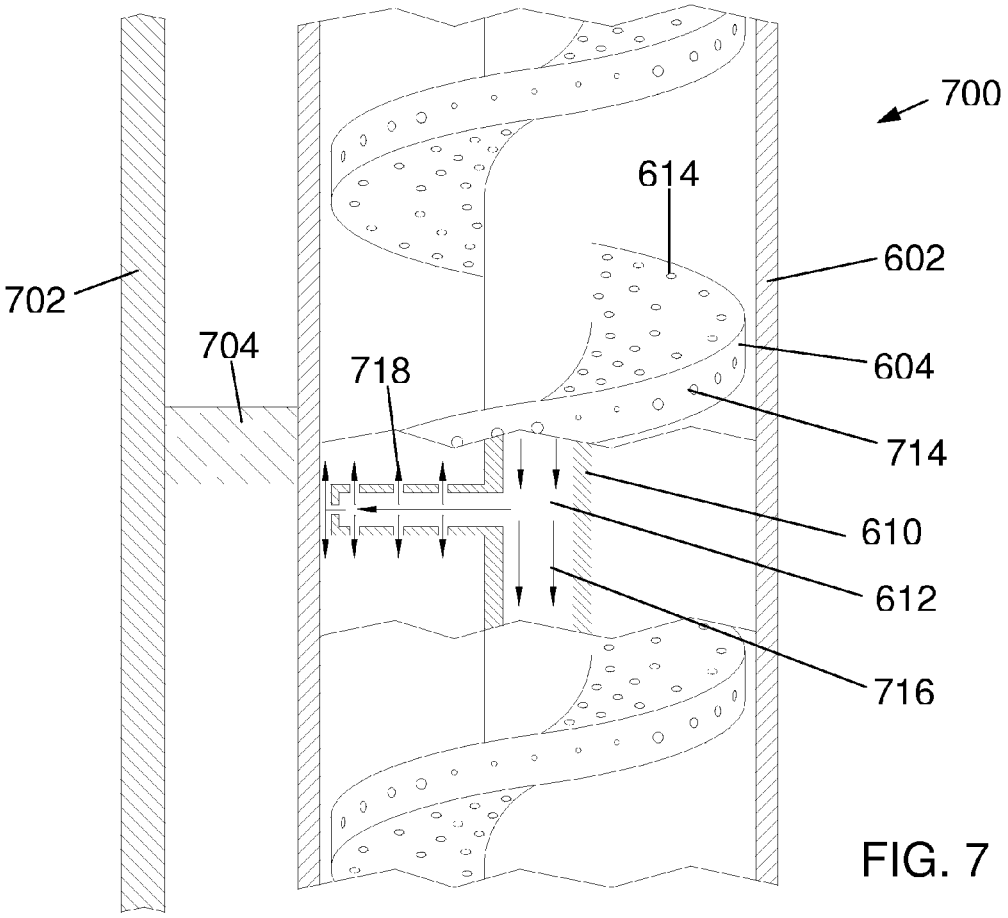
FIG. 7 is schematic side cross-sectional view of the pre-drying fuel chute from FIG. 6.

FIGS. 6 and 7 are schematic top 600 and side 700 views of a first embodiment of a fuel agitation and heating mechanism. The wall 602 of the pre-drying fuel chute is attached to the side wall 702 of the boiler by a plurality of supports 704. Preferably, supports 704 will have minimal thermal conduction between the pre-drying fuel chute and the boiler wall 702 in order to minimize conductive heat loss in order to minimize heating of the boiler wall 702 and maximize heating of the downward-moving fuel inside the fuel chute. In addition, wall 602 will typically heat up more than the boiler wall 702, thus undergoing more thermal expansion, so it is preferred that chute 602 be configured with expansion joints located between successive supports 704 (see FIG. 1). A central tube 610 may serve several functions: 1) providing mechanical support for the corkscrew fuel agitator 604, 2) supplying steam and/or hot air to the interior of agitator 604, 3) rotating agitator 604 (see arrow 608) within chute 602 to force the fuel downwards while breaking up clumps of fuel to facilitate thorough drying of the fuel as it passes downwards in the pre-drying fuel chute 602, and 4) maintaining a spacing 606 between the outer edge of agitator 604 and the inner surface of chute 602 to prevent abrasive damage to either agitator 604 or wall 602. Steam and/or hot air 716 passes through the central opening 612 in tube 610, and then flows 718 out from the interior of agitator 604 through openings 614 in the upper and lower surfaces of agitator 604. The steam and/or hot air also flow out through openings 714 in the outer edge of agitator 604. In this embodiment, steam and/or hot air flows out of both the upper and lower surfaces of agitator 604, as well as the edge, thus maximizing the agitating action of the steam and/or hot air to break up any clumps of wet fuel which would otherwise not dry adequately before passing through the length of the pre-drying fuel chute. The steam and/or hot air also serve to enhance conductive heat transfer from the hot walls 602 of the pre-drying fuel chute to the fuel. The steam and/or hot air may serve an additional function of cleaning the inside of the chute 602 and cooling chute 602 when this particular chute (but not all other chutes) is off-line during continuing boiler operation. Another function of agitator 604 is to prevent fuel from falling directly down the tube which might not allow adequate time within the fuel chute for drying—preferred transit times down the chute may typically be several minutes at least. Typical diameters for tube 602 may be 18 to 24 inches. In some embodiments, central tube 610 may be configured (not shown) with two passages, one passage configured to inject steam and/or hot air as illustrated in FIGS. 6 and 7, with the other passage configured to vent away evaporated water vapor and/or volatile gases emitted by the drying fuel.

Second Embodiment of a Fuel Agitator and Heating Mechanism

Figure 8:
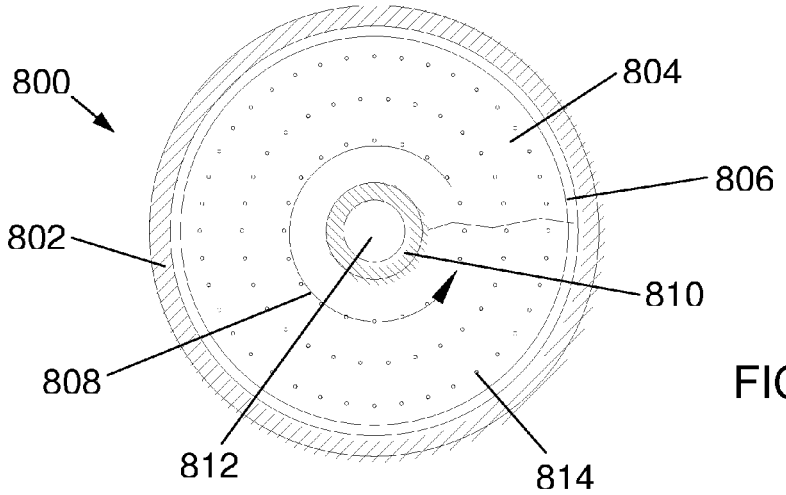
FIG. 8 is schematic top cross-sectional view of a second embodiment of a pre-drying fuel chute employing a fuel agitating and drying mechanism.
Figure 9:
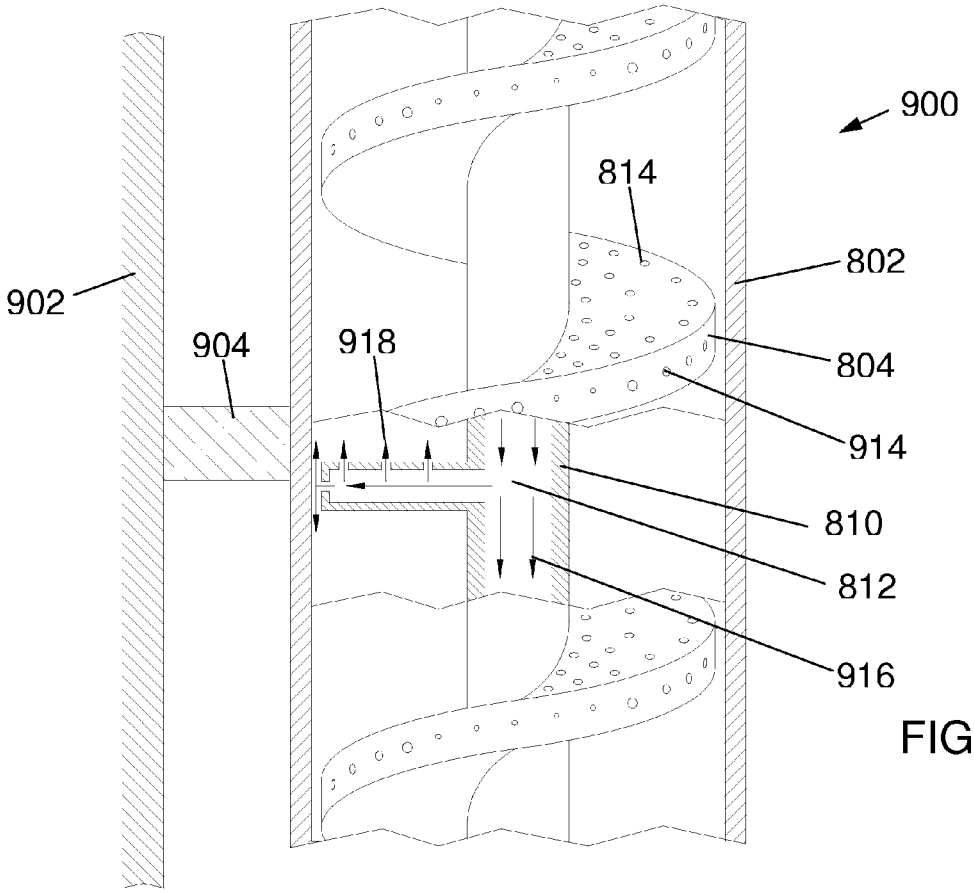
FIG. 9 is schematic side cross-sectional view of the pre-drying fuel chute from FIG. 8.

FIGS. 8 and 9 are schematic top 800 and side 900 views of a second embodiment of a fuel agitation and heating mechanism, which is similar to that shown in FIGS. 6 and 7, except for the distribution of openings for introduction of steam and/or hot air to the interior of the pre-drying fuel chute. The same considerations hold here for the design of the supports 904 attached to the side wall 902 of the boiler, as in FIGS. 6 and 7. A central tube 810 serves the same functions as central tube 610 in FIGS. 6 and 7. Steam and/or hot air 916 passes through the central opening 812 in tube 810, and then flows 918 out from the interior of agitator 804 through openings 814 in the upper surface of agitator 804. The steam and/or hot air also flow out through openings 914 in the outer edge of agitator 804. In this embodiment, steam or hot air flows out of only the upper surface of agitator 804, as well as the edge, thus breaking up any clumps of wet fuel which would otherwise not dry before passing through the length of the pre-drying fuel chute. The steam and/or hot air also serve to enhance conductive heat transfer from the hot walls 802 of the pre-drying fuel chute. The steam and/or hot air may serve an additional function of cleaning the inside of the chute 802 and cooling chute 802 when this particular chute (but not all other chutes) is off-line during continuing boiler operation. Another function of agitator 804 is to prevent fuel from falling directly down the tube which might not allow adequate time within the fuel chute for drying. Typical diameters for tube 802 may be 18 to 24 inches. In some embodiments, the central tube 810 may be configured (not shown) with two passages, one passage configured to inject steam and/or hot air as illustrated in FIGS. 8 and 9, with the other passage configured to vent away evaporated water vapor and/or volatile gases emitted by the drying fuel.

Third Embodiment of a Fuel Agitator and Heating Mechanism

Figure 10:
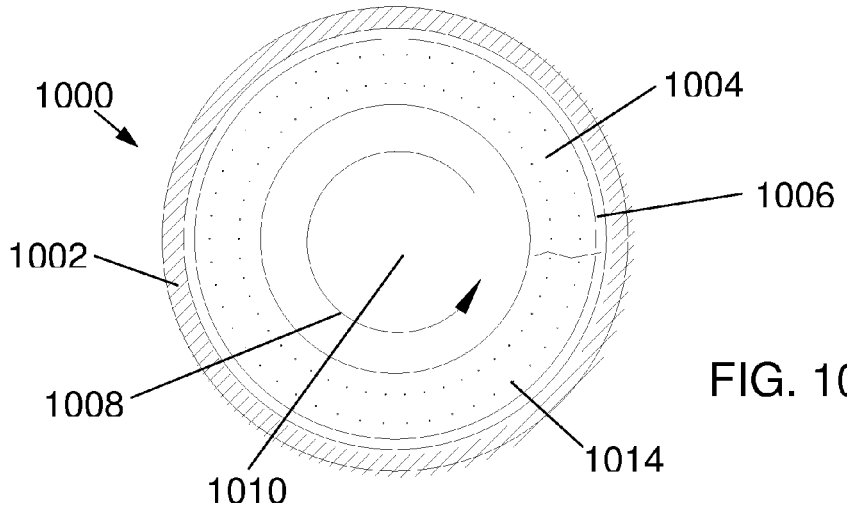
FIG. 10 is schematic top cross-sectional view of a third embodiment of a pre-drying fuel chute employing a fuel agitating and drying mechanism.
Figure 11:
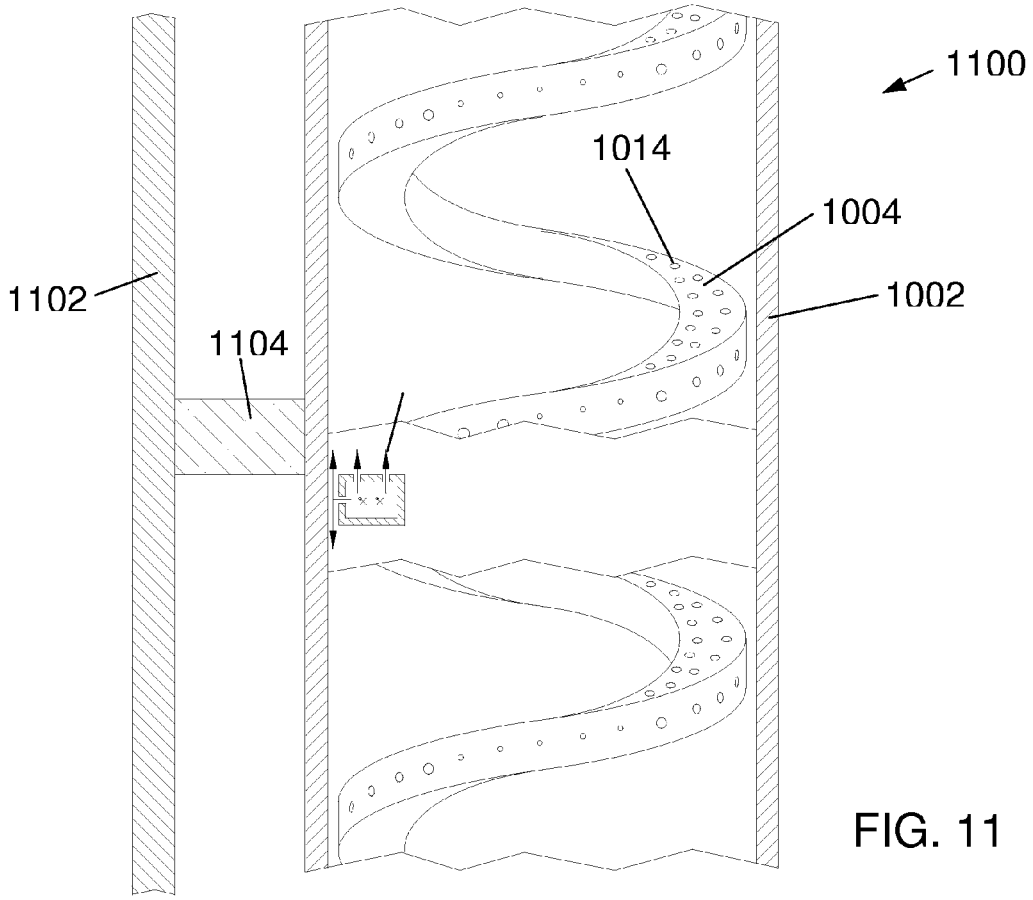
FIG. 11 is schematic side cross-sectional view of the pre-drying fuel chute from FIG. 10.

FIGS. 10 and 11 are schematic top 1000 and side 1100 views of a third embodiment of a fuel agitation and heating mechanism. The agitator 1004 in this embodiment resembles a large spring rotating (arrow 1008) within the circular wall 1002 of the pre-drying fuel chute. The same considerations hold here for the design of the supports 1104 attached to the side wall 1102 of the boiler, as in FIGS. 6-9. Steam and/or hot air flows within the interior of agitator 1004 and flows 1118 out of holes 1014 in the upper surface of agitator 1004, as well as holes in the outer edge of agitator 1004. The action of both the steam and/or hot air as well as mechanical rotation of agitator 1004 serves to break up clumps of fuel to enhance drying as the fuel moves downwards within the pre-drying fuel chute (according to FIGS. 3-5). The agitator 1004 must be mechanically stiff enough to perform several functions: 1) conduct steam and/or hot air throughout the interior of agitator 1004, 2) rotate agitator 1004 (see arrow 1008) within chute 1002 to force the fuel downwards within chute 1002 while breaking up clumps of fuel to facilitate thorough drying of the fuel as it passes downwards in the pre-drying fuel chute 1002, and 3) maintain a spacing 1006 between the outer edge of agitator 1004 and the inner surface of chute 1002 to prevent damage due to abrasion. The steam and/or hot air may serve an additional function of cleaning the inside of the chute 1002 and cooling chute 1002 when this particular chute (but not all other chutes) is off-line during continuing boiler operation. Another function of agitator 1004 is to prevent fuel from falling directly down the tube which might not allow adequate time within the fuel chute for drying. Typical diameters for tube 1002 may be 18 to 24 inches. In some embodiments, the agitator 1004 may be configured (not shown) with two passages, one passage configured to inject steam and/or hot air as illustrated in FIGS. 10 and 11, with the other passage configured to vent away evaporated water vapor and/or volatile gases emitted by the drying fuel.

Fourth Embodiment of a Fuel Agitator and Heating Mechanism

Figure 12:
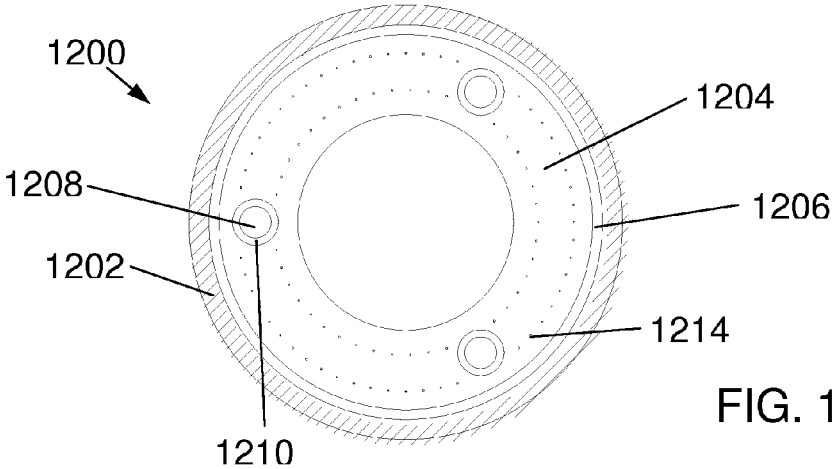
FIG. 12 is schematic top cross-sectional view of a fourth embodiment of a pre-drying fuel chute employing a fuel agitating and drying mechanism.
Figure 13:
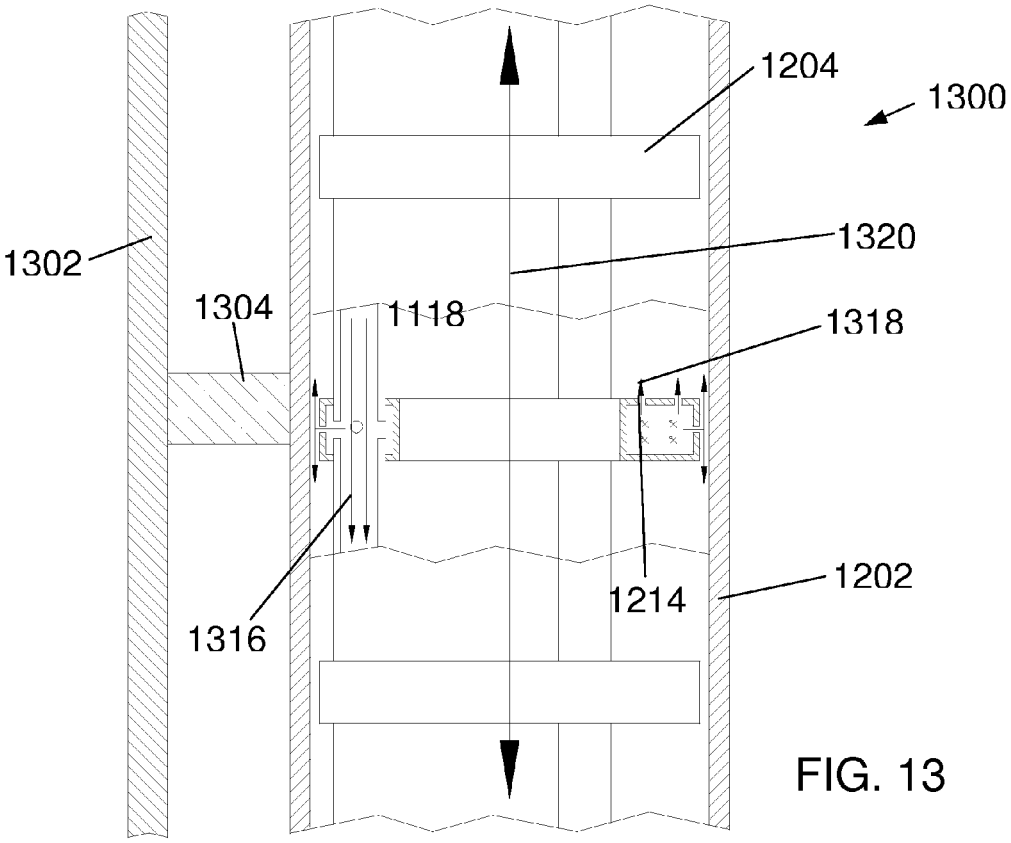
FIG. 13 is schematic side cross-sectional view of the pre-drying fuel chute from FIG. 12.

FIGS. 12 and 13 are schematic top 1200 and side 1300 views of a fourth embodiment of a fuel agitation and heating mechanism. The agitator 1204 in this embodiment comprises a plurality of horizontal circular hollow rings 1204 mounted on one or more (preferably at least two) support tubes 1210 with central openings 1208. The same considerations hold here for the design of the supports 1304 attached to the side wall 1302 of the boiler, as in FIGS. 6-11. Support tubes 1210 serve several functions: 1) providing mechanical support for the agitator rings 1204, 2) supplying steam and/or hot air to the interior of agitator rings 1204, 3) moving agitator rings 1204 (see arrow 1320) up and down in a reciprocating motion within chute 1202 to force the fuel downwards within chute 1202 while breaking up clumps of fuel to facilitate thorough drying of the fuel as it passes downwards in the pre-drying fuel chute 1202, and 4) maintaining a spacing 1206 between the outer edge of agitator 1204 and the inner surface of chute 1202 to prevent abrasion. Note that it is preferred that the vertical motion 1320 of agitator rings 1204 is at least equal to the spacing between rings 1204 to ensure complete removal of fuel which may be stuck to the inner surface of wall 1202. Steam and/or hot air 1316 passes through the central openings 1208 in tubes 1210, and then flows 1318 out from the interiors of agitator rings 1204 through openings 1214 in the upper (and, optionally, also lower) surfaces of agitator rings 1204. The steam and/or hot air also may flow out through openings in the outer edges of agitator rings 1204. The steam or hot air flowing out of both the agitator rings 1204 maximizes the agitating action of the steam and/or hot air to break up any clumps of wet fuel which would otherwise not dry adequately before passing through the length of the pre-drying fuel chute. The steam and/or hot air also serve to enhance conductive heat transfer from the hot walls 1202 of the pre-drying fuel chute to the fuel. The steam and/or hot air may serve an additional function of cleaning the inside of the chute 1202 and cooling chute 1202 when this particular chute (but not all other chutes) is off-line during continuing boiler operation. Another function of agitator rings 1204 is to prevent fuel from falling directly down the tube which might not allow adequate time within the fuel chute for drying. Typical diameters for tube 1202 may be 18 to 24 inches. In some embodiments, support tubes 1210 may be configured (not shown) with two passages, one passage configured to inject steam and/or hot air as illustrated in FIGS. 12 and 13, with the other passage configured to vent away evaporated water vapor and/or volatile gases emitted by the drying fuel.

Fifth Embodiment of a Fuel Agitator and Heating Structure

Figure 14:
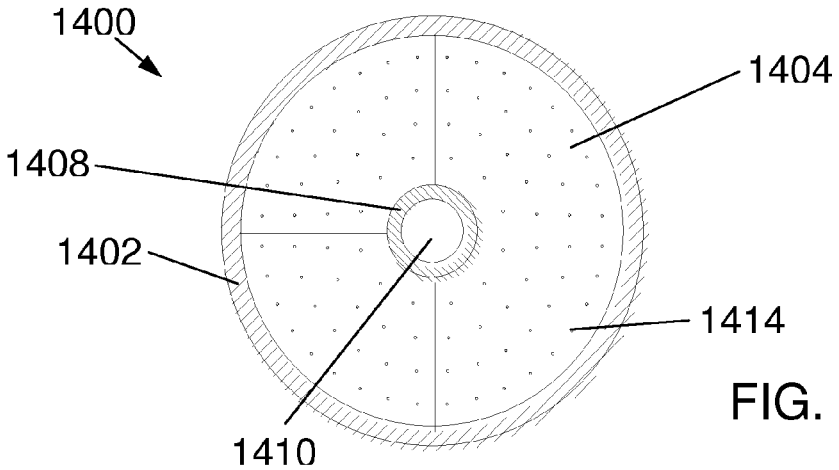
FIG. 14 is schematic top cross-sectional view of a fifth embodiment of a pre-drying fuel chute employing a fuel agitating and drying structure.
Figure 15:
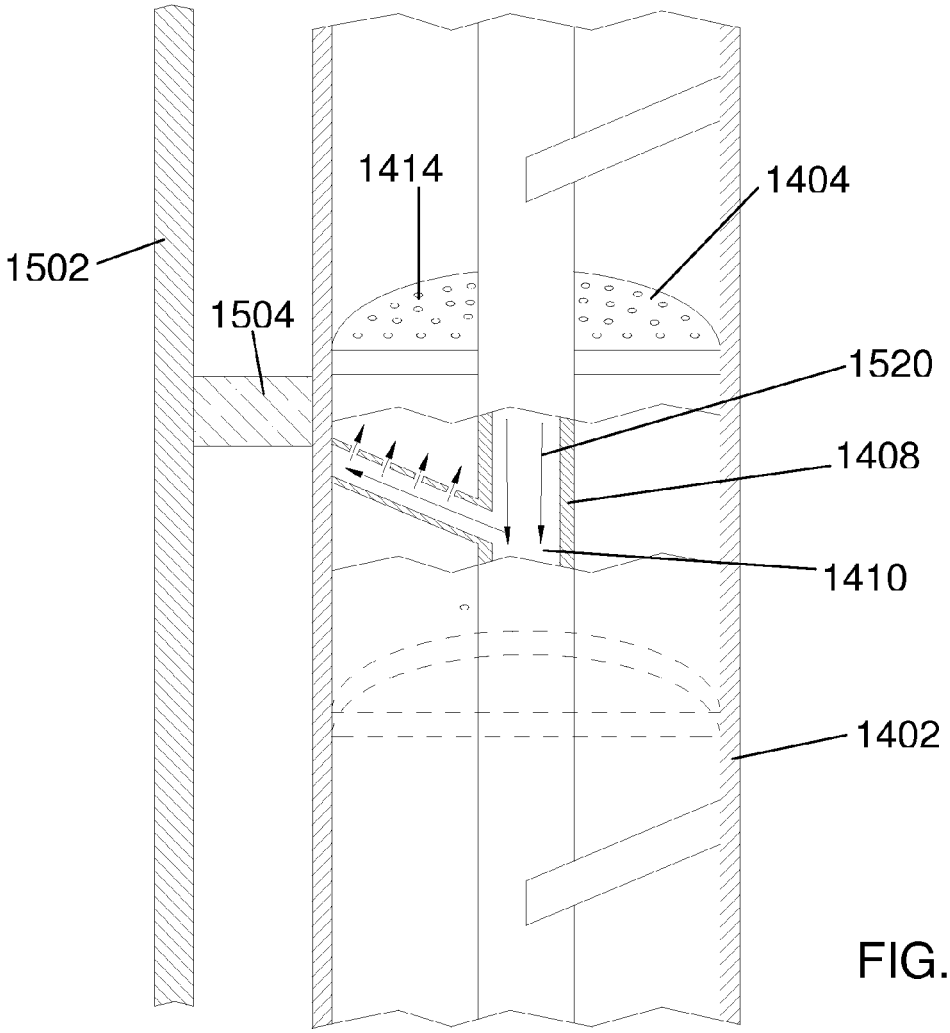
FIG. 15 is schematic side cross-sectional view of the pre-drying fuel chute from FIG. 14.

FIGS. 14 and 15 are schematic top 1400 and side 1500 views of a fifth embodiment of a fuel agitation and heating structure. The agitator in this embodiment may be a non-moving structure comprising a plurality of tilted plates 1404 mounted on a central tube 1408 having a central opening 1410, or the agitator in this embodiment may be configured with a rotary and/or oscillatory motion actuator. The same considerations hold here for the design of the supports 1504 attached to the side wall 1502 of the boiler, as in FIGS. 6-13. Support tube 1408 may serve two functions: 1) providing mechanical support for the agitator plates 1404, and 2) supplying steam and/or hot air to the interior of agitator plates 1404. Steam and/or hot air 1520 passes through the central opening 1410 in tube 1408, and then flows out from the interiors of agitator plates 1404 through openings 1414 in the upper (and, optionally, also lower) surfaces of agitator plates 1404. The steam and/or hot air flowing out of the agitator plates 1404 maximizes the agitating action of the steam and/or hot air to break up any clumps of wet fuel which would otherwise not dry adequately before passing through the length of the pre-drying fuel chute. The steam and/or hot air also serve to enhance conductive heat transfer from the hot walls 1402 of the pre-drying fuel chute. In configurations of this embodiment where there is no motion of the agitator, the flow of steam and/or hot air, coupled with the natural downwards vertical motion due to gravity, are the only mechanisms for breaking up clumps of wet fuel within the pre-drying fuel chute. The steam and/or hot air may serve an additional function of cleaning the inside of the chute 1402 and cooling chute 1402 when this particular chute (but not all other chutes) is off-line during continuing boiler operation. Another function of agitator plates 1404 is to prevent fuel from falling directly down the tube which might not allow adequate time within the fuel chute for drying. Typical diameters for tube 1402 may be 18 to 24 inches. In some embodiments, the central tube 1408 may be configured (not shown) with two passages, one passage configured to inject steam and/or hot air as illustrated in FIGS. 14 and 15, with the other passage configured to vent away evaporated water vapor and/or volatile gases emitted by the drying fuel.

Sixth Embodiment of a Fuel Agitator and Heating Structure

Figure 16:
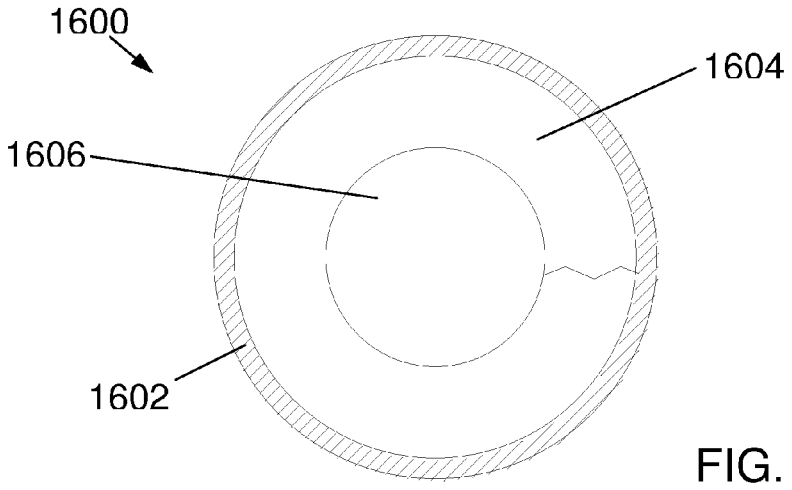
FIG. 16 is schematic top cross-sectional view of a sixth embodiment of a pre-drying fuel chute employing a fuel agitating and drying structure.
Figure 17:
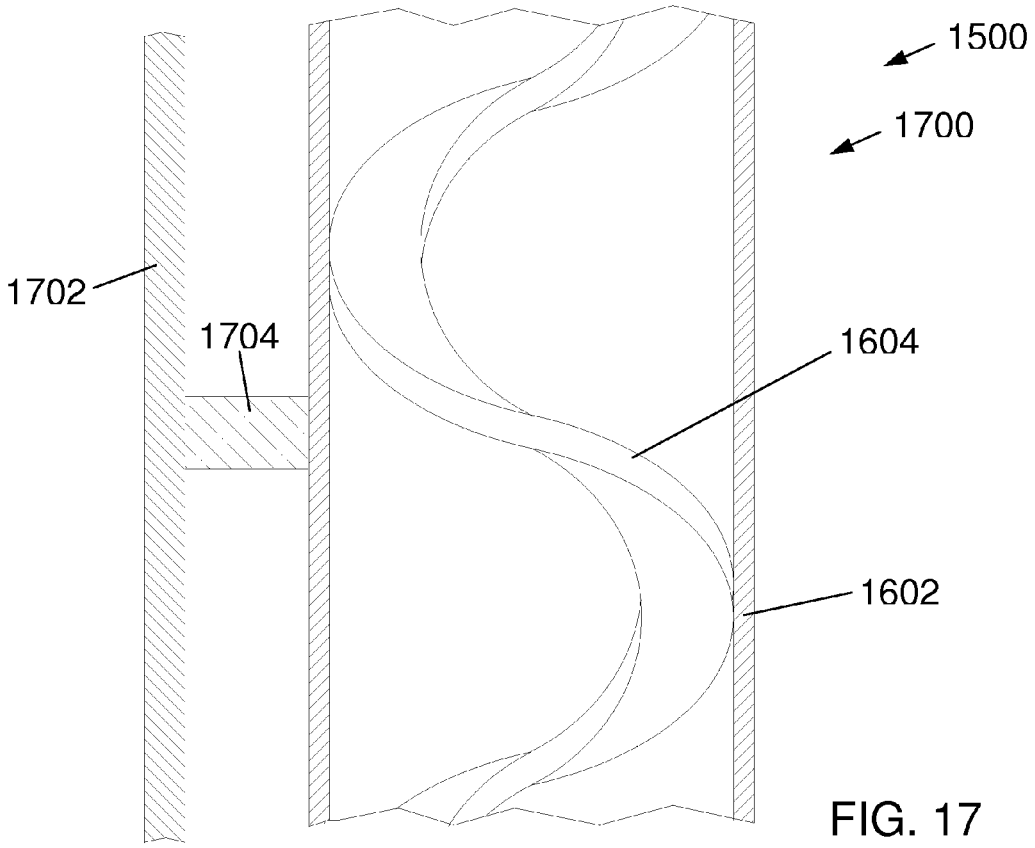
FIG. 17 is schematic side cross-sectional view of the pre-drying fuel chute from FIG. 16.

FIGS. 16 and 17 are schematic top 1600 and side 1700 views of a sixth embodiment of a fuel agitation and heating structure. The agitator in this embodiment comprises a corkscrew-shaped structure 1604 attached to the inner surface of the pre-drying fuel chute wall 1602. The same considerations hold here for the design of the supports 1704 attached to the side wall 1702 of the boiler, as in FIGS. 6-15. Optionally (not shown here), steam and/or hot air may pass through a central opening in structure 1604, and then flow out from openings in structure 1604. The steam and/or hot air flowing out of the structure 1604 may then maximize the agitating action of the steam and/or hot air to break up any clumps of wet fuel which would otherwise not dry adequately before passing through the length of the pre-drying fuel chute. The steam and/or hot air also could serve to enhance conductive heat transfer from the hot walls 1602 of the pre-drying fuel chute to the fuel. Note that for this embodiment of a fuel agitator and heating structure, there is no mechanical motion of the structure 1604 relative to wall 1602, thus the flow of steam and/or hot air, coupled with the natural downwards vertical motion due to gravity, would be the only mechanisms for breaking up clumps of wet fuel within the pre-drying fuel chute. Another function of agitator 1604 is to prevent fuel from falling directly down tube 1602 which might not allow adequate time within the fuel chute for drying. Typical diameters for tube 1602 may be 18 to 24 inches.

Seventh Embodiment of a Fuel Agitator and Heating Mechanism

Figure 18:
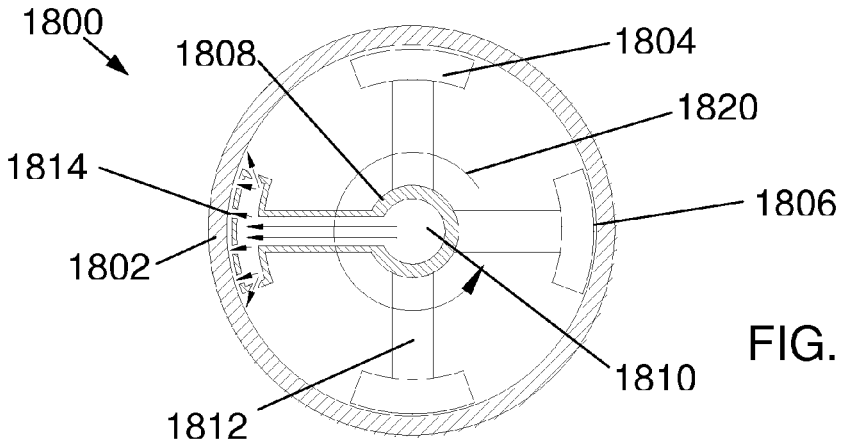
FIG. 18 is schematic top cross-sectional view of a sixth embodiment of a pre-drying fuel chute employing a fuel agitating and drying mechanism.
Figure 19:
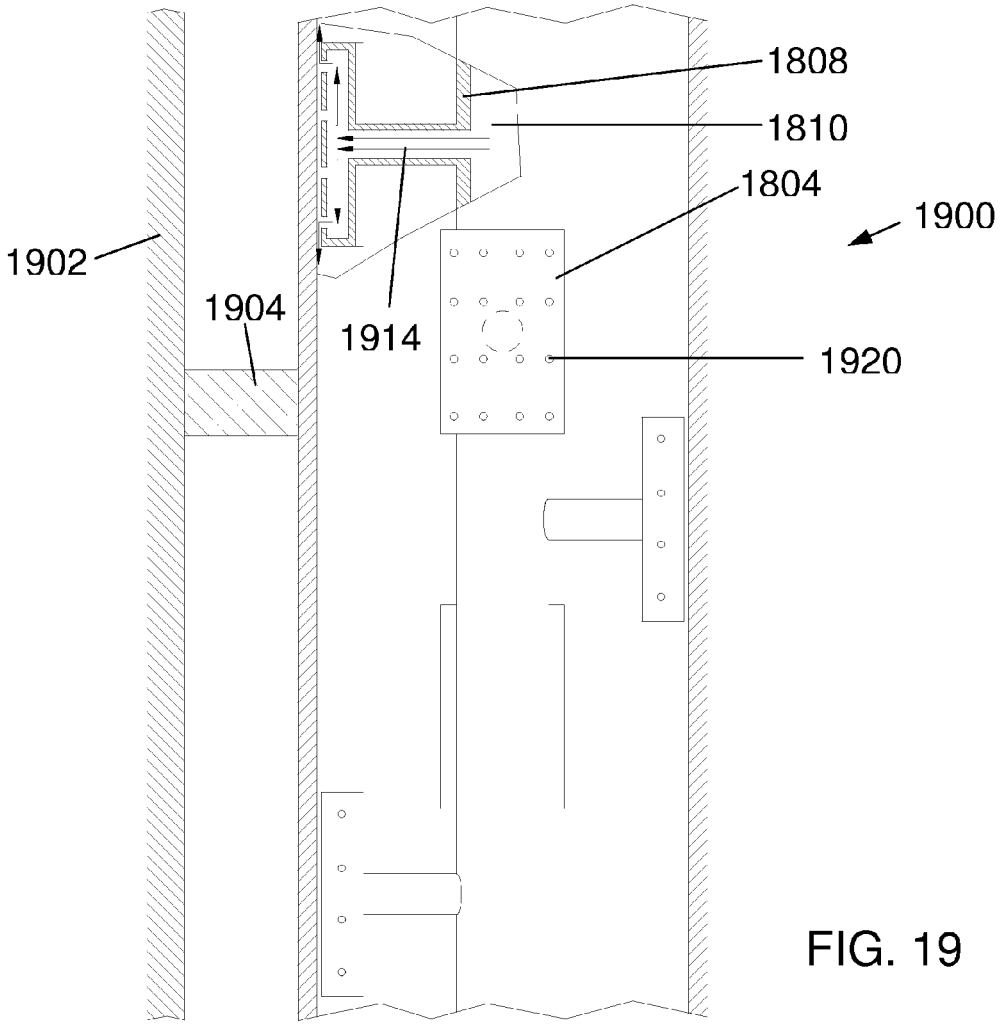
FIG. 19 is schematic side cross-sectional view of the pre-drying fuel chute from FIG. 18.

FIGS. 18 and 19 are schematic top 1800 and side 1900 views of a seventh embodiment of a fuel agitation and heating mechanism. The same considerations hold here for the design of the supports 1704 attached to the side wall 1702 of the boiler, as in FIGS. 6-15. A central tube 1808 serves several functions: 1) providing mechanical support for a multiplicity of agitator plates 1804, 2) supplying steam and/or hot air to the interiors of agitator plates 1804, 3) rotating agitator plates 1804 (see arrow 1820) within chute 1802 to scrape fuel off the interior surface of chute 1802 and force the fuel downwards within chute 1802 while breaking up clumps of fuel to facilitate thorough drying of the fuel as it passes downwards, and 4) maintaining a spacing 1806 between the outer edges of agitator plates 1804 and the inner surface of chute 1802 to prevent abrasion. Steam and/or hot air 1914 passes through the central opening 1810 in tube 1808, and then flows out 1814 from the interiors of agitator plates 1804 through openings 1920 in the outer surfaces of agitator plates 1804 which are supported by hollow posts 1812. The steam and/or hot air also serve to enhance conductive heat transfer from the hot walls 1802 of the pre-drying fuel chute to the fuel. The locations and sizes of the agitator plates 1804 preferably are configured to: 1) thoroughly mix and break up clumps, thereby enabling even heating and drying, 2) scrape every portion of the interior surface of chute 1802 by at least one agitator plate 1804, and 3) prevent fuel from falling directly down the tube 1802 which might not allow adequate time within the fuel chute for drying. Typical diameters for tube 1802 may be 18 to 24 inches. In some embodiments, the central tube 1808 may be configured (not shown) with two passages, one passage configured to inject steam and/or hot air as illustrated in FIGS. 18 and 19, with the other passage configured to vent away evaporated water vapor and/or volatile gases emitted by the drying fuel. The steam and/or hot air may serve an additional function of cleaning the inside of the chute 1802 and cooling chute 1802 when this particular chute (but not all other chutes) is off-line during continuing boiler operation.

Eighth Embodiment of a Fuel Agitator and Heating Mechanism

Figure 20:
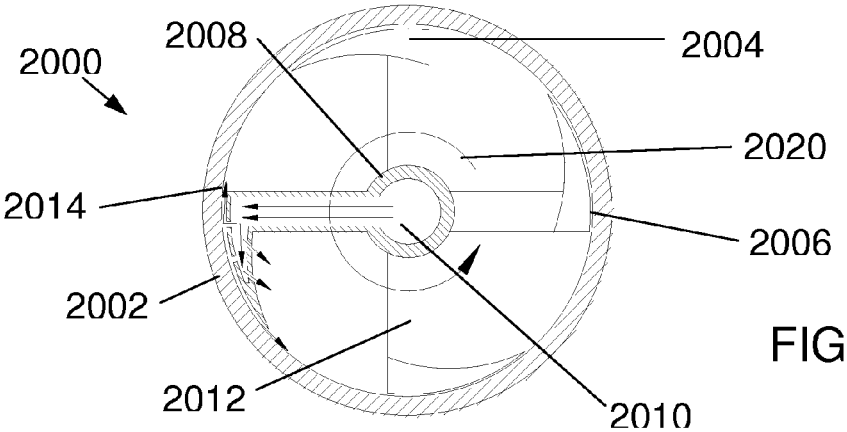
FIG. 20 is schematic top cross-sectional view of a sixth embodiment of a pre-drying fuel chute employing a fuel agitating and drying mechanism.
Figure 21:
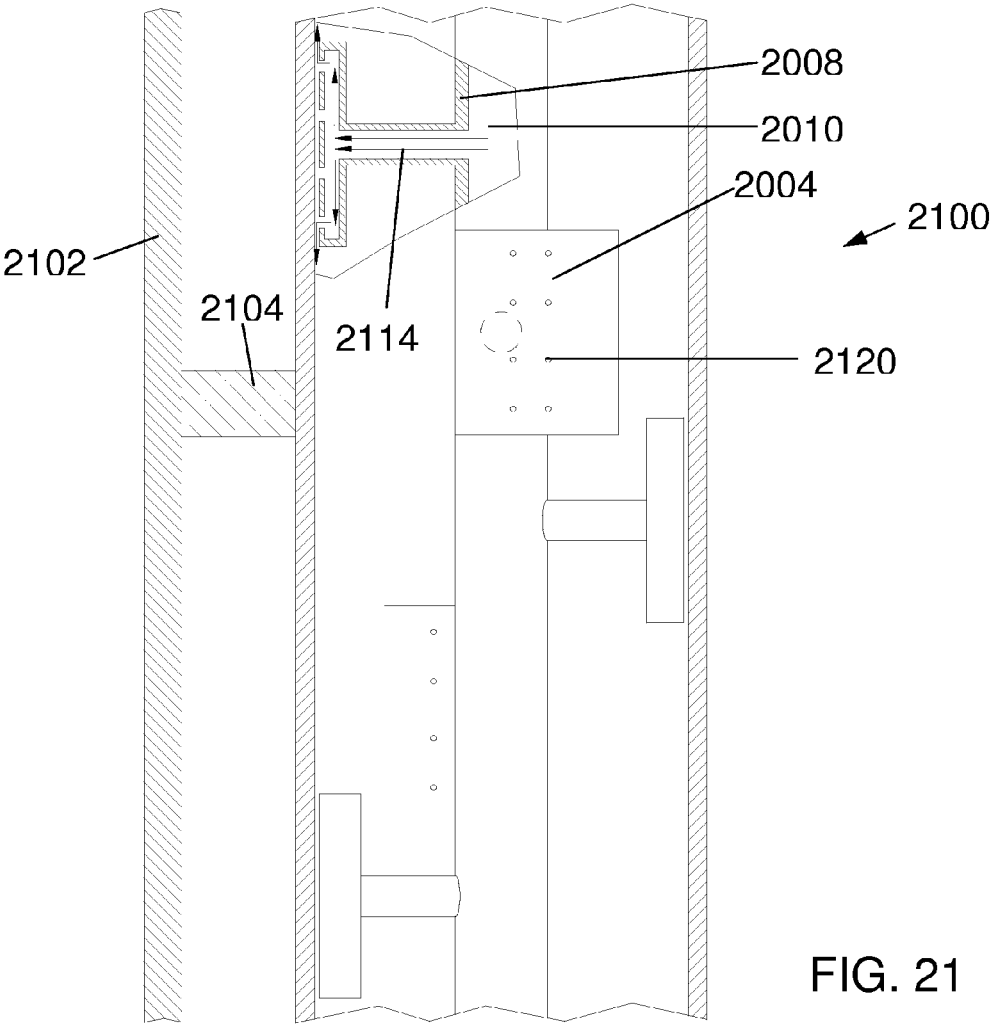
FIG. 21 is schematic side cross-sectional view of the pre-drying fuel chute from FIG. 20.

FIGS. 20 and 21 are schematic top 2000 and side 2100 views of an eighth embodiment of a fuel agitation and heating mechanism, which is similar to that shown in FIGS. 18 and 19, except for the shapes of the agitator plates 2004, which have sharp leading edges for this embodiment. The same considerations hold here for the design of the supports 2104 attached to the side wall 2102 of the boiler, as in FIGS. 6-19. A central tube 2008 serves several functions: 1) providing mechanical support for a multiplicity of agitator plates 2004, 2) supplying steam and/or hot air to the interiors of agitator plates 2004, 3) rotating the agitator plates 2004 (see arrow 2020) within chute 2002 to scrape fuel off the interior surface of chute 2002 and force the fuel downwards within chute 2002 while breaking up clumps of fuel to facilitate thorough drying of the fuel, and 4) maintaining a spacing 2006 between the outer edges of agitator plates 2004 and the inner surface of chute 2002 to prevent abrasion. Steam and/or hot air 2114 passes through the central opening 2010 in tube 2008, and then flows out from the interiors of agitator plates 2004 through openings 2020 in the outer surfaces of agitator plates 2004 supported by hollow posts 2012. The steam and/or hot air also serve to enhance conductive heat transfer from the hot walls 2002 of the pre-drying fuel chute. The locations and sizes of the agitator plates 2004 preferably ensure that every portion of the interior surface of chute 2002 is scraped by at least one agitator plate 2004. Another function of agitator plates 2004 and posts 2012 is to prevent fuel from falling directly down the tube which might not allow adequate time within the fuel chute for drying. Typical diameters for tube 2002 may be 18 to 24 inches. In some embodiments, the central tube 2008 may be configured (not shown) with two passages, one passage configured to inject steam and/or hot air as illustrated in FIGS. 20 and 21, with the other passage configured to vent away evaporated water vapor and/or volatile gases emitted by the drying fuel. The steam and/or hot air may serve an additional function of cleaning the inside of the chute 2002 and cooling chute 2002 when this particular chute (but not all other chutes) is off-line during continuing boiler operation.

Preferred Fuel Chute Materials

There are several requirements for the materials used to fabricate the pre-drying fuel chute: 1) high thermal conductivity, 2) high heat resistance, 3) high absorptivity/emissivity for the side facing the hot combustion gases, and 4) if possible, low absorptivity/emissivity for the side of the chute facing the boiler side walls. For mechanical considerations, it may not be possible to meet the fourth requirement since this could require fabricating the fuel chute from two different materials which likely would have differing thermal expansion coefficients (or at least different thermal expansion due to the resulting temperature differential between the two sides of the fuel chute). Examples of materials meeting requirements 1-3 include RA330 steel, stainless steel, refractory materials, or a combination of these.

Heat Transfer for Pre-Drying Fuel Chutes

Figure 22:
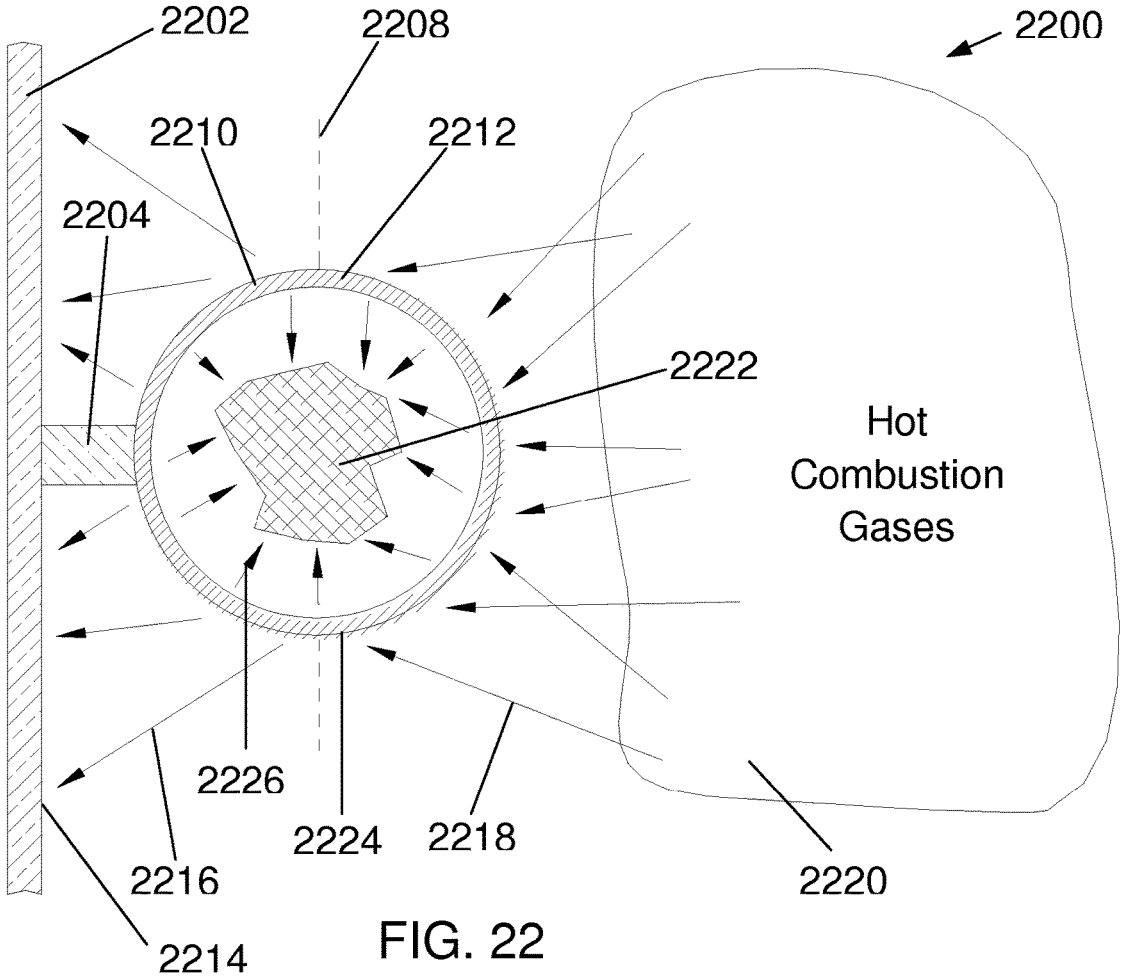
FIG. 22 is a top schematic diagram of heat flows with a pre-drying fuel chute.

FIG. 22 is a top schematic cross-sectional view 2200 of heat flows with a pre-drying fuel chute. A pre-drying fuel chute 2224 is shown with supports 2204 (one shown) attached to a side wall 2202 of a boiler. As discussed in FIGS. 6-21 above, it is preferred that the thermal conductivity of supports 2204 be minimized to reduce heat flow from the fuel chute 2210 to the sidewall 2202. This has the dual benefits of reducing the sidewall temperature, while increasing the temperature of the pre-drying fuel chute, thus improving fuel-drying efficiency. Hot combustion gases 2220 radiate heat (arrows 2218) towards the right side 2212 of chute 2224. Dashed line 2208 represents the division between portions of the outer surface of chute 2224 which tend to receive more radiant heat than they radiate away (surface 2212) and those portions of chute 2224 which radiate away more heat than they absorb (surface 2210). To maximize the radiant absorption of heat by the pre-drying fuel chute, then it is preferable to configure surface 2212 to have maximized absorbance (and thus emissivity) so that the largest amount of radiant heat 2218 from gases 2220 will be absorbed by the fuel chute 2224. Conversely, it is preferable to configure surface 2210 to have minimized emissivity (and thus absorbance) so that the minimal amount of heat is radiated away (arrows 2216) towards the side wall 2202 of the boiler. Within pre-drying fuel chute 2224, wet solid fuel 2222 is seen in being irradiated (arrows 2226) by the inner surface of chute 2224. Clearly the efficiency of this radiant heating will be increased by maximizing both the temperature and emissivity of the inner wall of chute 2224.

Because the pre-drying fuel chutes will be functional whenever the boiler is operational, some embodiments of the invention eliminate many of the failure modes of prior art boilers in which the dryer used a different heating source.

Pre-Drying Fuel Chute Cross-Sectional Shapes and Configurations

Although FIGS. 6-22 show circular cross-sectional shapes for the pre-drying fuel chutes, other cross-sectional shapes can also be used. Examples include square, rectangular, or polygonal cross-sections. Different cross-sectional shapes may be employed within a single pre-drying fuel chute, or between different fuel chutes within a single boiler.

Fuel chutes configured may comprise multiple sections to enable: 1) differential thermal expansion between the fuel chute and the boiler, 2) differential thermal expansion between portions of the fuel chute at different temperatures, and 3) replacement of worn sections of the fuel chute while retaining other unworn sections In some embodiments, the upper end of the fuel chute may be open to the interior region of the boiler, which is filled with rising hot combustion gases—in this example, the falling fuel within the fuel chute will create a down draft which will draw in some of the hot combustion gases, thereby enabling a co-current flow of falling fuel and hot combustion gases.

In some embodiments, the inner wall surface of the chute may have a rifled structure to: 1) reduce sticking of fuel to the wall surface, 2) increase the heat-transfer surface area, 3) enhance wear resistance, and 4) interact with the moving fuel agitator mechanisms to force the solid fuel downwards within the pre-drying fuel chute.

Flow Chart for Prior Art Fuel Drying Methods

Figure 23:
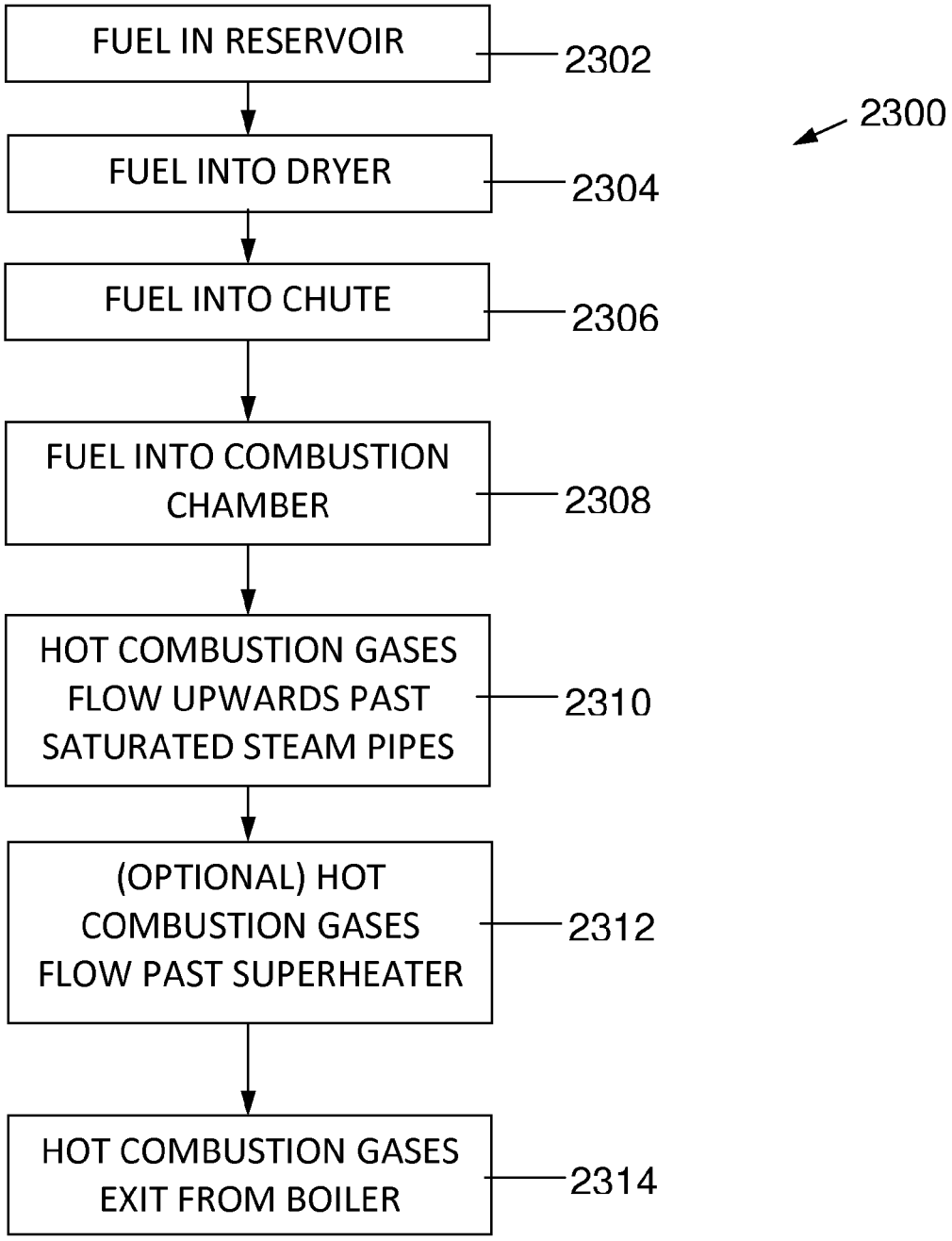
PRIOR ART FIG. 23
FIG. 23 is a flow chart of the steps in a prior art fuel drying process.

FIG. 23 is a flow chart 2300 of the steps in a prior art fuel drying process. Wet solid fuel is initially stored in a reservoir in step 2302. This fuel may comprise various types of biomass material, such as bark, sludge, refuse, tires, coal, wood waste, and other organic materials, often combined, and with fossil fuels. Typically the organic materials may have high moisture content and are stored outdoors where they may be exposed to rain or snow. The sludge materials may be reclaimed from wastewater treatment plants. The wet fuel from the reservoir is then typically transferred to a dryer in step 2304, as discussed in the Background section above. Once dried, the fuel is then loaded into a chute in step 2306 and enters the combustion chamber step 2308 of the boiler, where it is ignited and burned, producing hot combustion gases. These hot gases then flow upwards past one or more banks of tubes to generate saturated steam step 2310. Optionally, these gases may then flow across one or more additional banks of tubes containing initially saturated steam which is then heated to form superheated steam step 2312. The hot combustion gases then exit the boiler in step 2314. In some cases, the dried fuel from step 2304 is not immediately fed to the fuel chute, and instead is stored in a fuel bin for later use.

Flow Chart for Fuel Drying Methods

Figure 24:
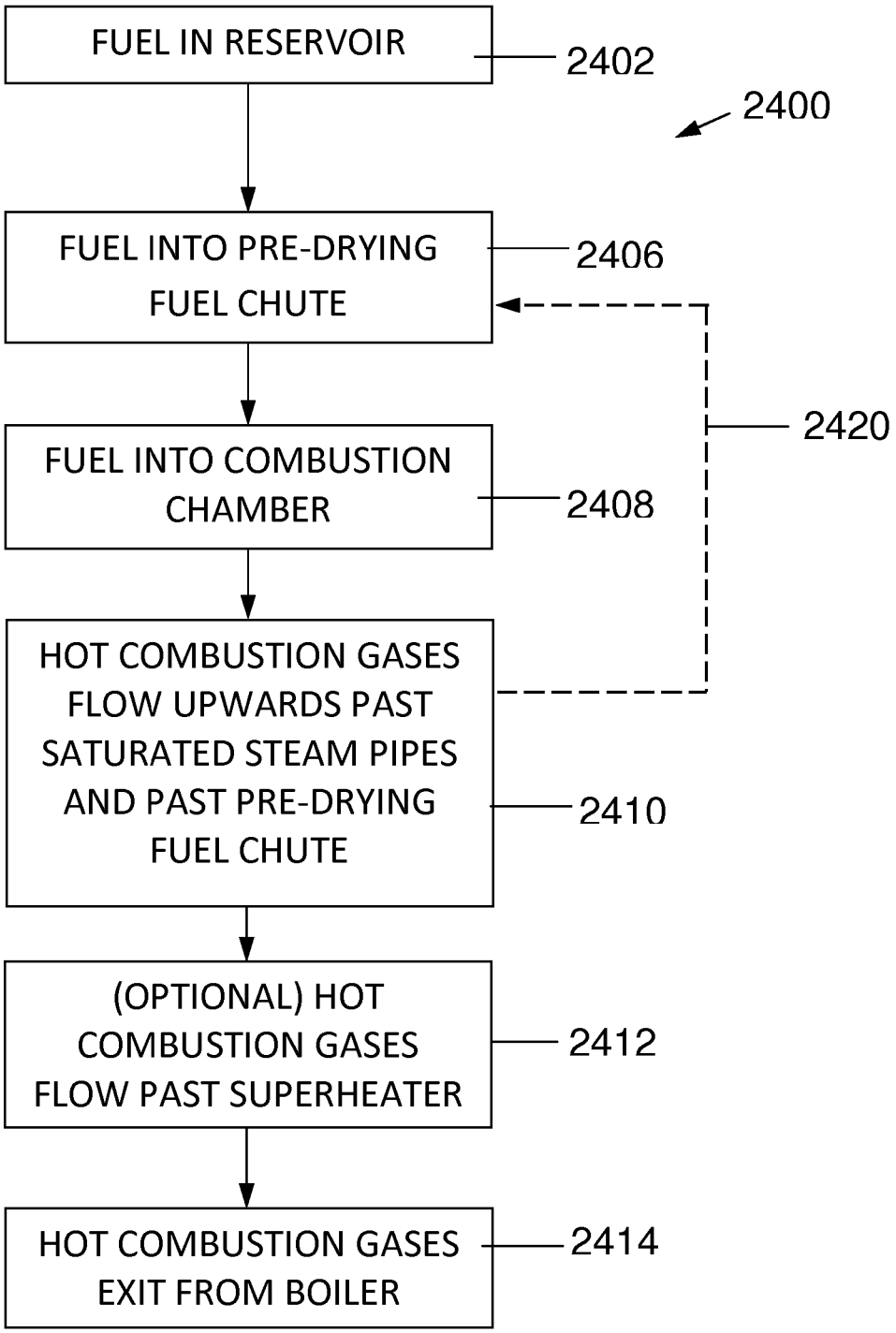
FIG. 24 is a flow chart of preferred steps in a fuel pre-drying process embodying the present invention.

FIG. 24 is a flow chart 2400 of the steps in an improved fuel pre-drying process. As in FIG. 23, the wet solid fuel is initially stored in a reservoir in step 2402. The same considerations apply to this fuel as in FIG. 23. The wet fuel from the reservoir is then transferred to a pre-drying fuel chute configured in step 2306. As the initially-wet fuel passes through the pre-drying fuel chute, it is heated and dried, as discussed in FIGS. 3-22 above. The fuel then may then be stored in an enclosed fuel bin, configured to prevent exposure to rain and snow, and with adequate ventilation to prevent the accumulation of explosive gases from the heated fuel. Either immediately after passage through the pre-drying fuel chute, or after a subsequent storage time in the fuel bin, the fuel enters the combustion chamber in step 2408 of the boiler, where it is ignited and burned, producing hot combustion gases. These hot gases then flow upwards past one or more banks of tubes to generate saturated steam step 2310. In some embodiments, these hot combustion gases also flow over the outer surface of one or more pre-drying fuel chutes, as illustrated by arrow 2420. Optionally, these gases may then flow across one or more additional banks of tubes containing initially saturated steam which is then heated to form super-heated steam in step 2412. The hot combustion gases then exit the boiler in step 2414.

The terms "pre-drying" and "drying" used are used here interchangeably, as the fuel is dried either before storage or immediately before combustion.

Some embodiments provide a solid fuel boiler, comprising:

walls defining a combustion chamber;

a combusting zone within the combustion chamber into which the solid fuel is delivered for combusting;

a heated zone within the combustion chamber and above the combusting zone through which gases heated in the combustion zone pass; and a fuel chute positioned within the heated zone, the fuel chute including:

walls separating the fuel in the chute from the gas in the heated zone, the walls being heated by hot gases in the heated zone and radiating heat to the fuel within the chute, wherein the fuel within the chute absorbs heat, and is thereby partially dried;

a first opening through which solid fuel enters the fuel chute from outside the combustion chamber, the solid fuel having a first moisture content;

a second opening through which the fuel exits the chute, the fuel exiting the chute having a second moisture content, the second moisture content being lower than the first moisture content.

In some embodiments, the hot gases contact the fuel chute over more than 75% of the circumference of the fuel chute within the combustion chamber.

In some embodiments, the second opening opens into the combustion chamber and fuel exiting the fuel chute exits towards the combusting zone.

In some embodiments, the second opening opens outside of the combustion chamber and fuel exiting the fuel chute exits towards a fuel storage bin.

In some embodiments, the fuel chute is composed of steel, stainless steel or a refractory material.

In some embodiments, the fuel chute includes a device within the fuel chute to mix and agitate the fuel within the chute, thereby ensuring more uniform heating of the fuel and facilitating the flow of fuel in the fuel chute.

In some embodiments, the fuel chute includes a device within the fuel chute to assist the downward motion of the fuel in the fuel chute.

In some embodiments, the device comprises a device that moves the fuel through the fuel chute as the device rotates.

In some embodiments, the device comprises a spiral-shaped device.

In some embodiments, the device comprises a device that moves the fuel through the fuel chute as the device rotates that agitates the fuel.

In some embodiments, the device comprises an agitator mechanism to facilitate the flow of fuel in the fuel chute.

In some embodiments, the solid fuel boiler comprises a second fuel chute positioned within the heated zone; the fuel exiting the first fuel chute into the combustion zone; and the fuel exiting the second fuel chute into a fuel bin outside of the combustion chamber.

In some embodiments, the fuel exits the first fuel chute into the combustion zone and the fuel exits the second fuel chute into a fuel bin outside of the combustion chamber.

In some embodiments, the fuel chute includes a portion in which the fuel chute is oriented vertically and a portion in which the fuel chute is oriented at a non-zero angle to the vertical.

In some embodiments, a portion of the fuel chute other than the second open to the combustion chamber so that hot gases from the combustion chamber is drawn into the fuel chute to dry the fuel flowing in the chute.

In some embodiments, the hot gases from the combustion chamber are drawn into the fuel chute by the falling of the fuel.

In some embodiments, the fuel chute enters the combustion chamber through a first wall or through the top of the combustion chamber near the first wall and exits the combustion chamber at either the first wall or a second wall.

In some embodiments, the first and second walls are the same wall.

In some embodiments, hot gases or steam is directed through the fuel in the fuel chute to assist in drying the fuel.

In some embodiments, the fuel chute includes one or more obstructions to prevent the free-fall of wet solid fuel through the fuel chute, thereby slowing down the passage of the fuel to enable adequate heating and drying of the fuel.

In some embodiments, a portion of the outer surface of the fuel chute which faces towards the side walls of the combustion chamber comprises a material having a lower thermal emissivity than a second portion of the fuel cute that faces towards the combustion chamber, thereby reducing the loss of thermal energy from the fuel chute towards the sidewalls.

In some embodiments, walls separating the fuel in the chute from the gas in the heated zone are configured so that the fuel is enclosed in the fuel chute within the combustion chamber over at least ½ the length of the fuel chute in the combustion chamber.

In some embodiments, the inner surfaces of the walls separating the fuel in the chute from the gas in the heated zone have rifled surfaces.

In some embodiments, all, or a portion of, the fuel chute is configured to be able to rotate around an axis parallel to the axis of the chute.

In some embodiments, the second opening opens outside of the combustion chamber and fuel exiting the fuel chute exits towards a fuel storage bin adjacent to the combustion chamber.

Some embodiments provide a method of drying fuel, comprising:

directing the fuel through a fuel chute enclosing the fuel, a portion of the fuel chute being positioned within a combustion chamber of solid fuel boiler; and providing hot combustion gas within the combustion chamber to contact and heat the exterior of the fuel chute, and the hot fuel chute heating the fuel inside chute by radiation.

In some embodiments, the method further comprises directing hot combustion gas into the fuel chute to assist in drying the fuel.

In some embodiments, the method includes directing the fuel from the fuel chute to a fuel storage bin outside of the combustion chamber.

In some embodiments, the method includes directing the fuel from the fuel chute to a combustion zone inside the combustion chamber.

In some embodiments, directing the fuel through a fuel chute enclosing the fuel includes directing the fuel into a fuel chute configured so that at least ½ of the distance traveled by the fuel in the fuel chute is travelled in an enclosed portion of the fuel chute inside the combustion chamber.

In some embodiments, directing the fuel through a fuel chute enclosing the fuel includes directing the fuel through multiple fuel chutes within the combustion chamber.

Some embodiments provide a method of pre-drying fuel for use in a solid fuel boiler, comprising:

directing the fuel through a multiplicity of fuel chutes, each fuel chute enclosing the fuel, a portion of each fuel chute being positioned within a combustion chamber of a solid fuel boiler;

providing hot combustion gas contacting each fuel chute, the hot gases heating the exterior of each fuel chute, and each heated fuel chute heating the fuel inside each chute by radiation, convection or conduction; and directing the fuel exiting the fuel chute to a fuel storage bin outside the combustion chamber for storage.

In some embodiments, the method further comprises removing fuel from the fuel storage bin and burning the fuel in a solid fuel boiler.

In some embodiments, the method further comprises venting of evaporated moisture and volatile gases from the fuel storage bin.

In some embodiments, the fuel storage bin is configured with a live bottom to transfer from the fuel bin.

In some embodiments, the fuel storage bin is configured with a fire suppression system utilizing one or more of: a water mist, steam, chemicals, or other fire-suppression means.

In some embodiments, the fuel storage bin is a single storage bin into which all of the fuel chutes in the multiplicity of fuel chutes empty.

In some embodiments, the fuel storage bin comprises a multiplicity of storage bins, and wherein one or more of the fuel chutes in the multiplicity of fuel chutes empties into each storage bin in the multiplicity of storage bins.

Alternative Embodiments

Although some embodiments and their advantages are described in detail above and below, it should be understood that the described embodiments are examples only, and that various changes, substitutions and alterations can be made herein without departing from the spirit and scope of the invention as defined in the appended claims. The scope of the present application is not intended to be limited to the particular embodiments of the process, machine, manufacture, composition of matter, means, methods, and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the invention.

We claim as follows:

1. A solid fuel boiler, comprising:

walls defining a combustion chamber;

a combusting zone within the combustion chamber into which solid fuel is delivered for combusting;

a heated zone within the combustion chamber and above the combusting zone through which gases heated in the combustion zone pass; and a fuel chute positioned within the heated zone adjacent one of the walls, the fuel chute including:

walls separating the fuel in the chute from the hot gases in the heated zone, the walls being heated by hot gases in the heated zone and radiating heat to the fuel within the chute, wherein the fuel within the chute absorbs heat, and is thereby partially dried;

a first opening through which solid fuel enters the fuel chute from outside the combustion chamber, the solid fuel having a first moisture content; and a second opening through which the fuel exits the chute, the fuel exiting the chute having a second moisture content, the second moisture content being lower than the first moisture content.

2. The solid fuel boiler of claim 1 in which the hot gases contact the fuel chute over more than 75% of the circumference of the fuel chute within the combustion chamber.

3. The solid fuel boiler of claim 1 in which the second opening opens into the combustion chamber and fuel exiting the fuel chute exits towards the combusting zone.

4. The solid fuel boiler of claim 1 in which the second opening opens outside of the combustion chamber and fuel exiting the fuel chute exits towards a fuel storage bin.

5. The solid fuel boiler of claim 1 in which the fuel chute is composed of steel, stainless steel or a refractory material.

6. The solid fuel boiler of claim 1 in which the fuel chute includes a device within the fuel chute to mix the fuel within the chute, thereby ensuring more uniform heating of the fuel.

7. The solid fuel boiler of claim 6 in which the device within the fuel chute to mix the fuel comprises an agitator mechanism to facilitate a flow of fuel in the fuel chute.

8. The solid fuel boiler of claim 1 in which the fuel chute includes a device within the fuel chute to assist downward motion of the fuel in the fuel chute.

9. The solid fuel boiler of claim 8 in which the device to assist the downward motion of the fuel comprises a device that moves the fuel through the fuel chute as the device rotates.

10. The solid fuel boiler of claim 9 in which the device to assist the downward motion of the fuel comprises a spiral-shaped device.

11. The solid fuel boiler of claim 8 in which the device to assist the downward motion of the fuel comprises a device that moves the fuel through the fuel chute as the device rotates and agitates the fuel.

12. The solid fuel boiler of claim 1 in which the fuel chute comprises a first fuel chute and further comprising a second fuel chute positioned within the heated zone.

13. The solid fuel boiler of claim 12 in which the fuel exits the first fuel chute into the combustion zone and fuel exits the second fuel chute into a fuel bin outside of the combustion chamber.

14. The solid fuel boiler of claim 1 in which the fuel chute includes a first portion in which the fuel chute is oriented vertically and a second portion in which the fuel chute is oriented at a non-zero angle to the vertical.

15. The solid fuel boiler of claim 1 in which a portion of the fuel chute other than the second opening is open to the combustion chamber so that hot gases from the combustion chamber are drawn into the fuel chute to dry the fuel flowing in the chute.

16. The solid fuel boiler of claim 15 in which the hot gases from the combustion chamber are drawn into the fuel chute by falling of the fuel.

17. The solid fuel boiler of claim 1 in which the fuel chute enters the combustion chamber through a first wall or through a top of the combustion chamber near the first wall and exits the combustion chamber at a second wall.

18. The solid fuel boiler of claim 1 in which the hot gases or steam is directed through the fuel in the fuel chute to assist in drying the fuel.

19. The solid fuel boiler of claim 1 in which the fuel chute includes one or more obstructions to prevent free-falling of wet solid fuel through the fuel chute, thereby slowing down passage of the fuel to enable adequate heating and drying of the fuel.

20. The solid fuel boiler of claim 1 in which a portion of the outer surface of the fuel chute which faces towards the adjacent wall of the combustion chamber comprises a material having a lower thermal emissivity that a second portion of the fuel cute that faces towards the combustion chamber, thereby reducing loss of thermal energy from the fuel chute towards the adjacent wall.

21. The solid fuel boiler of claim 1 in which walls separating the fuel in the chute from the gasses in the heated zone are configured so that the fuel is enclosed in the fuel chute within the combustion chamber over at least ½ the length of the fuel chute in the combustion chamber.

22. The solid fuel boiler of claim 1 in which the walls separating the fuel in the chute from the gasses in the heated zone have rifled surfaces inside the fuel chute.

23. The solid fuel boiler of claim 1 in which all, or a portion of, the fuel chute is configured to be able to rotate around an axis parallel to the axis of the chute.

24. The solid fuel boiler of claim 1 in which the second opening opens outside of the combustion chamber and fuel exiting the fuel chute exits towards a fuel storage bin adjacent to the combustion chamber.

25. A method of pre-drying fuel for use in a solid fuel boiler, comprising:

directing the fuel through a multiplicity of fuel chutes, each fuel chute enclosing some of the fuel, a portion of each fuel chute being positioned within, and adjacent a wall of, a combustion chamber of the solid fuel boiler;

providing hot combustion gas contacting each fuel chute, the hot gases heating the exterior of each fuel chute, and each heated fuel chute heating the fuel inside each chute by radiation, convection or conduction;

directing the fuel exiting at least one of the fuel chutes to a fuel storage bin outside the combustion chamber for storage.

26. The method of claim 25 further comprising removing fuel from the fuel storage bin and burning the fuel in a solid fuel boiler.

27. The method of claim 25 further comprising venting of evaporated moisture and volatile gases from the fuel storage bin.

28. The method of claim 25, wherein the fuel storage bin is configured with a live bottom to transfer stored fuel from the fuel storage bin.

29. The method of claim 25, wherein the fuel storage bin is configured with a fire suppression system utilizing one or more of: a water mist, steam, chemicals, or other fire-suppression means.

30. The method of claim 25, wherein the fuel storage bin is a single storage bin into which all of the fuel chutes in the multiplicity of fuel chutes empty.

31. The method of claim 25, wherein the fuel storage bin comprises a multiplicity of storage bins, and wherein one or more of the fuel chutes in the multiplicity of fuel chutes empties into each storage bin in the multiplicity of storage bins.

* * * * *